US012798873B2

(12) United States Patent
Dufresne et al.

(10) Patent No.: US 12,798,873 B2
(45) Date of Patent: Nov. 17, 2026

(54) ANCHORING ASSEMBLY INCLUDING A TIGHTENING MECHANISM FOR HOLDING AN UNDERGROUND STORAGE TANK

(71) Applicant: PULTRUSION TECHNIQUE INC., St-Bruno-de-Montarville (CA)

(72) Inventors: Robert Dufresne, St-Bruno-de-Montarville (CA); Simon Balit-Achim, St-Bruno-de-Montarville (CA); Hamid Arabzadeh, St-Bruno-de-Montarville (CA); Xavier Dufresne, St-Bruno-de-Montarville (CA)

(73) Assignee: PULTRUSION TECHNIQUE INC., Quebec (CA)

( * ) Notice: Subject to any disclaimer, the term of this patent is extended or adjusted under 35 U.S.C. 154(b) by 163 days.

(21) Appl. No.: 18/564,724

(22) PCT Filed: Jun. 3, 2022

(86) PCT No.: PCT/CA2022/050895
§ 371 (c)(1),
(2) Date: Nov. 28, 2023

(87) PCT Pub. No.: WO2022/251974
PCT Pub. Date: Dec. 8, 2022

(65) Prior Publication Data

US 2024/0182236 A1 Jun. 6, 2024

Related U.S. Application Data

(60) Provisional application No. 63/196,899, filed on Jun. 4, 2021.

(51) Int. Cl.
*B65D 90/12* (2006.01)
*B65D 88/76* (2006.01)

(52) U.S. Cl.
CPC ..... *B65D 90/12* (2013.01); *B65D 88/76* (2013.01)

(58) Field of Classification Search
CPC . B65D 90/12; B65D 88/76; F17C 2205/0184; F16G 11/12
See application file for complete search history.

(56) References Cited

U.S. PATENT DOCUMENTS 2,479,172 A 8/1949 Landon
5,655,265 A 8/1997 Schneider et al.
(Continued)

FOREIGN PATENT DOCUMENTS

DE 102008011769 9/2009
WO 20220251974 12/2022

OTHER PUBLICATIONS

Intentional Bureau, International Search Report and Written Opinion dated Sep. 9, 2022 in PCT/CA2022/050895.
(Continued)

*Primary Examiner* — Stephen J Castellano
(74) *Attorney, Agent, or Firm* — SNELL & WILMER L.L.P.

(57) ABSTRACT

An anchoring assembly and related system and method for facilitating the securing a holding strap to a storage tank and holding of the latter to the ground, comprising a base that is connectable to a top surface of the storage tank and an anchor that is reversibly secured to the base and positionable in a transverse direction of the storage tank to anchor a proximal end of the holding strap. The anchor includes a tightening mechanism being supported above the top surface of the storage tank by the base, wherein the tightening mechanism is actuable to move the anchor with respect to the top surface of the storage tank, thereby modifying a tension of the holding strap.

27 Claims, 62 Drawing Sheets

(56) References Cited

U.S. PATENT DOCUMENTS

| | | | |
|---|---|---|---|
| 2003/0205499 | A1 | 11/2003 | Burwell et al. |
| 2014/0145058 | A1 | 5/2014 | Watson et al. |

OTHER PUBLICATIONS

EPO, European Supplementary Search Report dated Mar. 12, 2025 in EP Application No. 22814663.5.

ANCHORING ASSEMBLY INCLUDING A TIGHTENING MECHANISM FOR HOLDING AN UNDERGROUND STORAGE TANK

CROSS REFERENCE TO RELATED APPLICATIONS

This application is a U.S. national stage entry under 35 U.S.C. § 371 of International Application No. PCT/CA2022/050895 filed Jun. 3, 2022 entitled "AN ANCHORING ASSEMBLY INCLUDING A TIGHTENING MECHANISM FOR HOLDING AN UNDERGROUND STORAGE TANK." The '895 PCT claims priority to, and the benefit of, U.S. Provisional Application Ser. No. 63/196,899 filed on Jun. 4, 2021, entitled "AN ANCHORING ASSEMBLY INCLUDING A TIGHTENING MECHANISM FOR HOLDING AN UNDERGROUND STORAGE TANK." Each of the foregoing applications are hereby incorporated by reference in their entirety for all purposes.

TECHNICAL FIELD

The present techniques generally relate to maintaining underground storage tanks in place and, more particularly, to an anchoring assembly for holding an underground storage tank and including a tightening mechanism for adjusting a tension of a strap component secured to the hook assembly.

BACKGROUND

Underground storage tanks, commonly referred to as USTs, are often used in storing fluids such as petroleum fluids, fuels, solvents, water or other fluid products.

Installation of USTs presents a number of challenges. Typically, anchoring structures commonly called "deadman anchors" are placed within an excavation pit beside the UST, straps are arranged to overly the UST along its length, and the straps are connected to the anchoring structures by various types of connectors that may include turnbuckles and hooks. For example, tightening the straps to securely hold the UST in place can be difficult and inefficient.

Various challenges related to the installation and tightening of the holding straps that overly the UST remain to be overcome.

SUMMARY

There is provided an anchoring assembly, a related system further including an underground storage tank, and a method for securing a holding strap to a storage tank via the anchoring assembly. The anchoring assembly includes:

- a base that is connectable to a top surface of the storage tank, the base comprising a seat member extending upwardly from the top surface of the storage tank; and
- an anchor that is reversibly secured to the base and positionable in a transverse direction of the storage tank, the anchor including:
  - a hook component being configured to anchor a proximal end of the holding strap; and
  - a tightening mechanism that is connected to the hook component and being supported above the top surface of the storage tank by the seat member of the base, wherein the tightening mechanism is actuable to move the hook component with respect to the top surface of the storage tank, thereby modifying a tension of the holding strap.

In some implementations, the seat member rests on the top surface of the storage tank. Optionally, the seat member is slidably engaged with the top surface of the storage tank via surface friction.

In some implementations, the base further comprises a sole member having a lower surface that rests onto the top surface of the storage tank, and the seat member protruding from an upper surface of the sole member. Optionally, the sole member can be slidably engaged with the top surface of the storage tank via surface friction. Further optionally, the sole member can be arched along a transverse direction of the storage tank to follow a curvature of the top surface of the tank. Yet further optionally, the sole member can further include two opposed bent edge portions for the installation of the base on a rib of the storage tank.

In some implementations, the seat member and the sole member can be formed as a one-piece structure.

In some implementations, the seat member can be connected to the upper surface of the sole member via welding, gluing, screwing, or riveting.

In some implementations, the hook component can define a loop and the holding strap is engageable to the hook component via insertion of the proximal end of the holding strap into the loop of the hook component. For example, the hook component is configured to engage a D-hook, a 90-degree D-hook or a C-hook that defines the proximal end of the holding strap. For example, the hook component is an O-ring, a D-hook, a 90-degree D-hook, or a C-hook.

In some implementations, the seat member defines at least one recess for receiving the anchor therein and position the tightening mechanism above the top surface of the storage tank. Optionally, the at least one recess is a single notch defined in an upper portion of the seat member. Further optionally, the seat member includes a pair of opposed upward arms and the at least one recess comprises a pair of opposed notches, each notch being defined in an upper portion of the upward arms. Yet further optionally, the at least one recess can be a single channel defined in an upper portion of the seat member, with the anchor being slidable through the channel. For example, the at least one recess can be sized and shaped to receive the hook component of the anchor therein.

In some implementations, the tightening mechanism of the anchor includes:

- a travelling member being operatively connected to the hook component; and
- a rotating member being operatively connected to the travelling member, wherein the rotation of the rotating member actuates the displacement of the travelling member, thereby modifying the tension of the holding strap that is secured to the hook component.

In some implementations, the hook component can form a one-piece structure with the travelling member.

In some implementations, the rotating member can be abutted to the seat member of the base.

In some implementations, the seat member can define a recess that is sized and shaped to receive the travelling member of the tightening mechanism therein, and to allow translation of the travelling member with respect to the recess. For example, the recess can be a notch defined in an upper portion of the seat member. For example, the recess can be a channel defined in an upper portion of the seat member, with the travelling member being slidable through the channel. For example, the recess can be a primary recess, and the seat member further comprises a secondary recess that is sized and shaped to receive at least one of the hook component and the end of the holding strap.

In some implementations, the travelling member can include a threaded bolt and the rotating member comprises a complementary nut, the hook component being operatively connected to a proximal end of the threaded bolt, and the threaded bolt being movable with respect to the nut via rotation of the nut. Optionally, the hook component can be integrally moulded with the threaded bolt, and rotation of the nut leads to screwing or unscrewing of the threaded bolt to adjust the tension of the holding strap that is attached thereto. Further optionally, the travelling member can further include a secondary nut that is engaged or integral with a proximal end region of the threaded bolt.

In some implementations, the travelling member can be a threaded bore, and the rotating member is a complementary threaded bolt that is rotatable within the threaded bore to actuate translation of the threaded bore and the connected hook component.

In some implementations, the anchor can be at least one anchor, and the at least one anchor comprising a first anchor and a second anchor to secure a holding strap on each opposed side of the storage tank. Optionally, the tightening mechanism of the first anchor is connected to the tightening mechanism of the second anchor via an elongated connecting body. Further optionally, the first anchor and the second anchor are connected to form a turnbuckle.

In some implementations, the base can be at least one base, and the at least one base comprises a first base and a second base positionable onto the top surface of the storage tank in axial symmetry with respect to each other. Optionally, the seat member of the first base and the seat member of the second base can be connected via a link member to further distribute mechanical constraints that are imposed by opposed tensions of the two holding straps. Further optionally, the seat member of the first base and the seat member of the second base can be connected to a same sole member extending along the top surface of the storage tank.

In another aspect, there is provided an anchoring assembly for securing a holding strap to a storage tank, the anchoring assembly comprising:

- an arched base securable to a top surface of the storage tank, the base comprising:
  - a seat member extending upwardly from the top surface of the storage tank; and
- an anchor securable to the base and positionable in a transverse direction of the storage tank, the anchor comprising:
  - a hook component being configured to anchor a proximal end of the holding strap; and
  - a tightening mechanism comprising:
    - a rotating member being supported by the seat member of the base, and
    - a travelling member being operatively connected to the hook component;

wherein the tightening mechanism is actuable to move the hook component with respect to the base via displacement of the travelling member, thereby modifying a tension of the holding strap.

The arched base, seat member, anchor, hook component, tightening mechanism, rotating member, and travelling member can further be as defined in any implementation as described herein, unless two implementations are incompatible.

In another aspect, there is provided a system for anchoring an underground storage tank to the ground. The system includes the anchoring assembly as described herein and securable to a top region of the storage tank, an anchor base that can be laid below the ground, and a holding strap having a distal end that is secured to the anchor base (e.g., via a retention mechanism) and a proximal end that is secured to the hook component of the present anchoring assembly.

In another aspect, there is provided a method for anchoring the holding strap to a side of the storage tank via the presently encompassed anchoring assembly. The method further comprises placing the anchor onto the base, e.g., via the seat member, and anchoring the holding strap to the hook component of the anchor. Tension of the holding strap can then be adjusted via actuation/rotation of the rotating member with respect to the travelling member of the tightening mechanism. More particularly, several techniques can be employed to secure and tighten a holding strap to the tank via attachment to both anchor base and anchor assembly. For example, the holding strap can be secured to each one of the anchor base and the anchor assembly on the transport truck or on-site, before being lowered into an excavation pit. Once lowered, a portion of the pit can be filled with a filler such as soil, gravel and/or crushed stone. Then, tension of the holding strap is adjusted via actuation of the rotating member of each anchor assembly located at the top of the tank.

BRIEF DESCRIPTION OF THE DRAWINGS

Implementations of the anchoring assembly are represented in and will be further understood in connection with the following figures.

While the invention will be described in conjunction with example embodiments, it will be understood that it is not intended to limit the scope of the invention to these embodiments.

DETAILED DESCRIPTION

Figure 1:
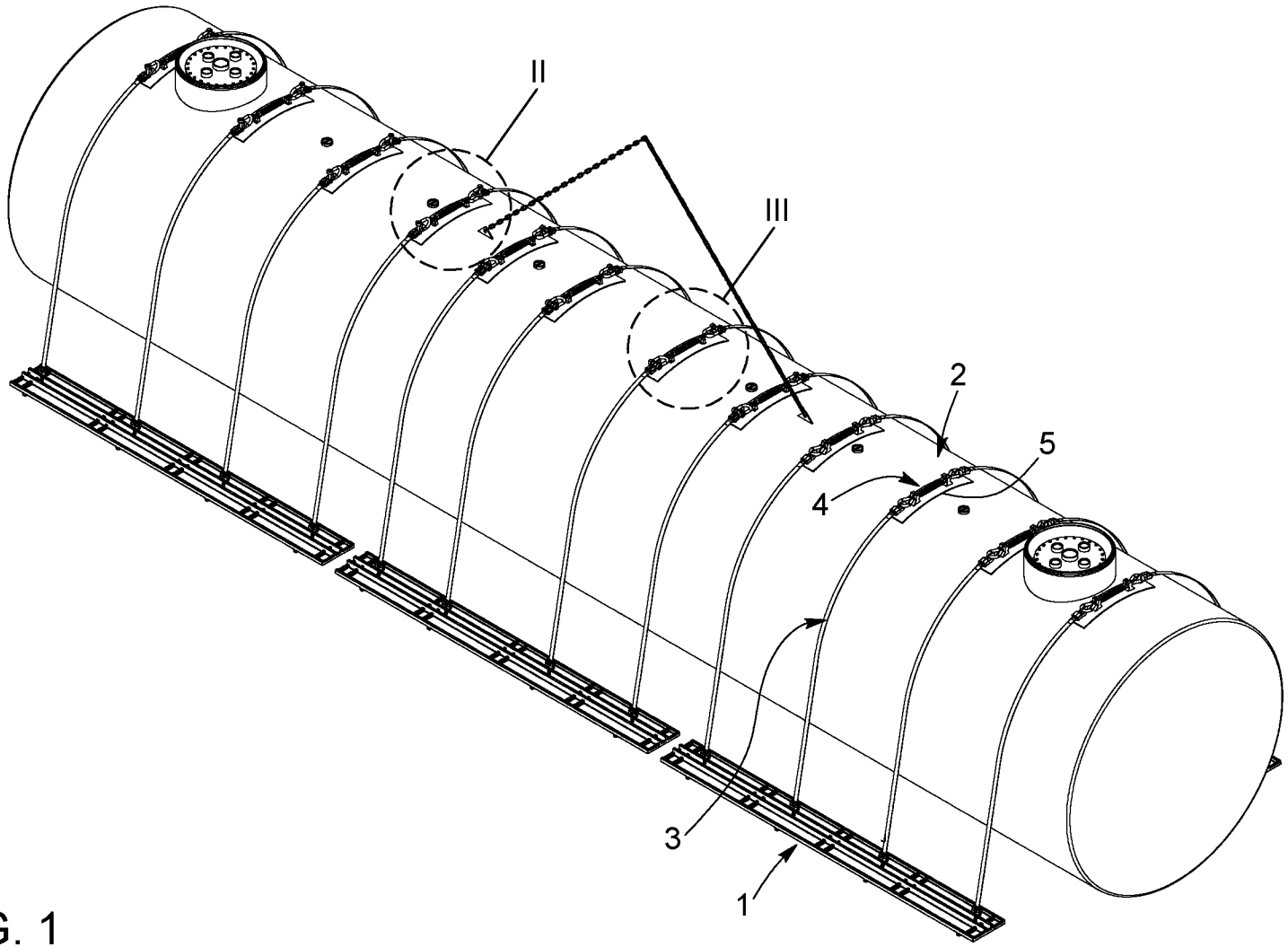
FIG. 1 is a top perspective view of a storage tank of metal type and having a substantially flat external surface, the tank being equipped with a plurality of anchoring assemblies according to multiple implementations thereof.
Figure 2:
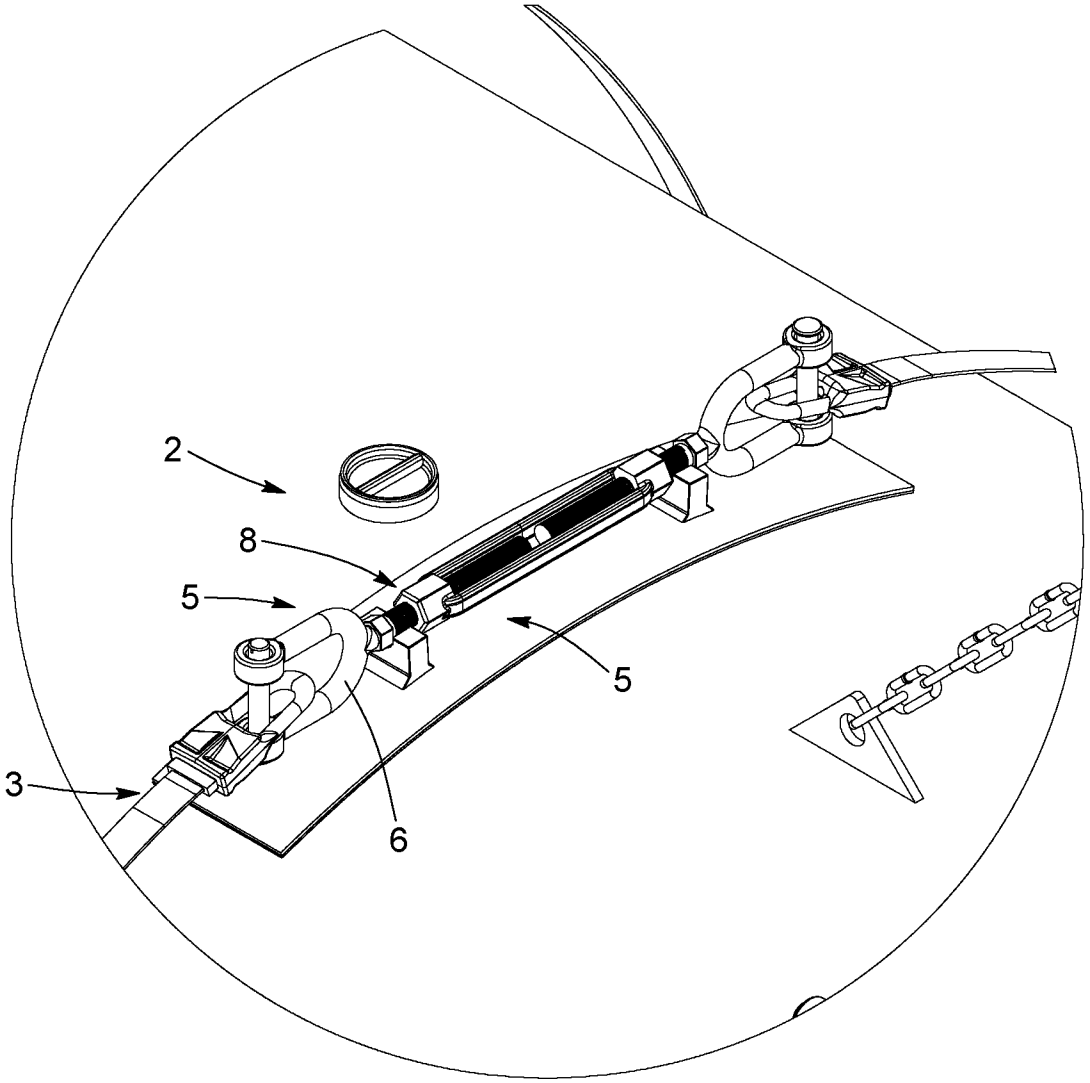
FIG. 2 is zoomed view of a portion II of FIG. 1 showing an anchoring assembly including a base, a hook component and a tightening mechanism that is operatively connected to the storage tank according to an example implementation.
Figure 3:
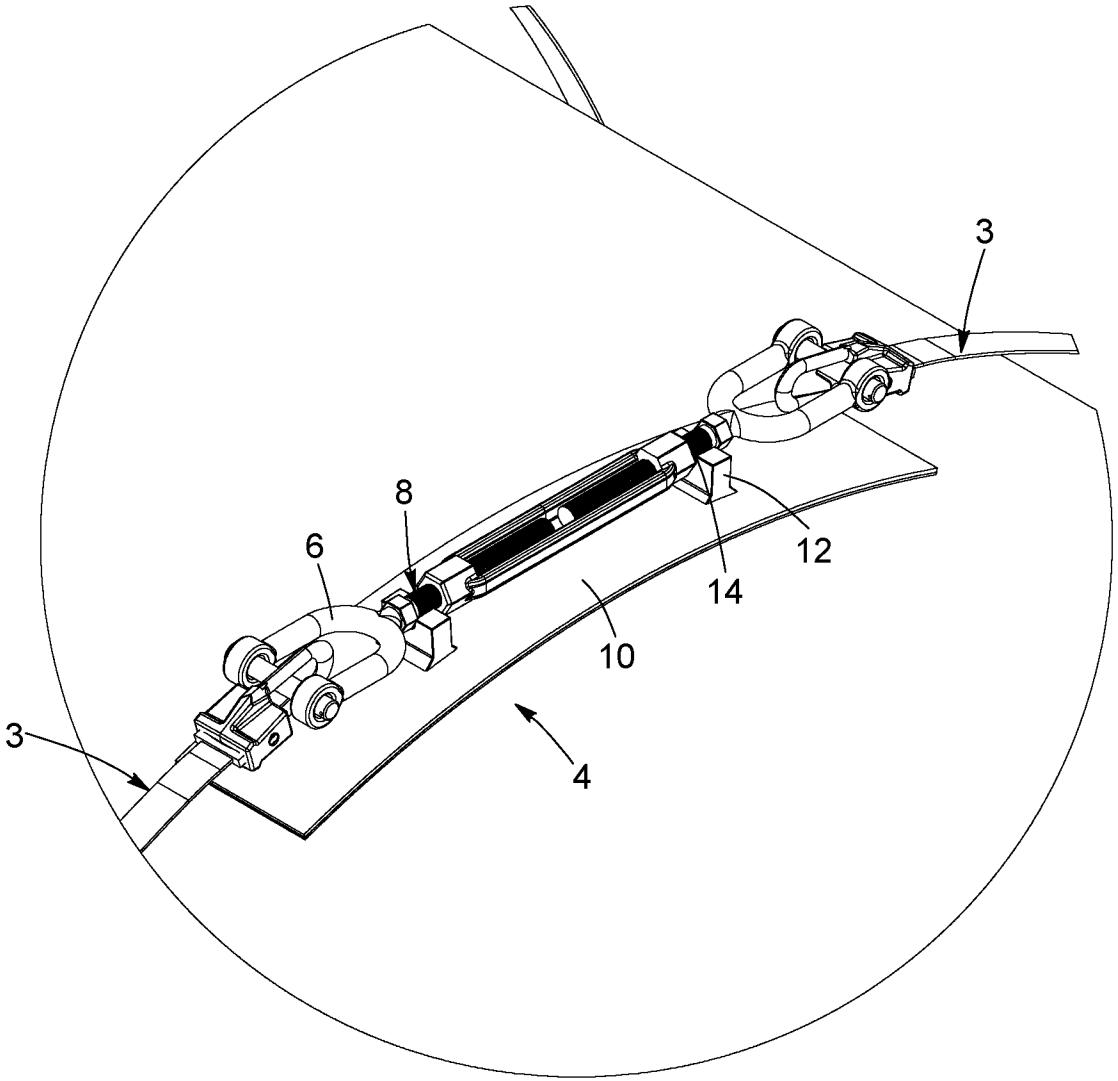
FIG. 3 is zoomed view of a portion III of FIG. 1 showing the anchoring assembly according to another example implementation.
Figure 14:
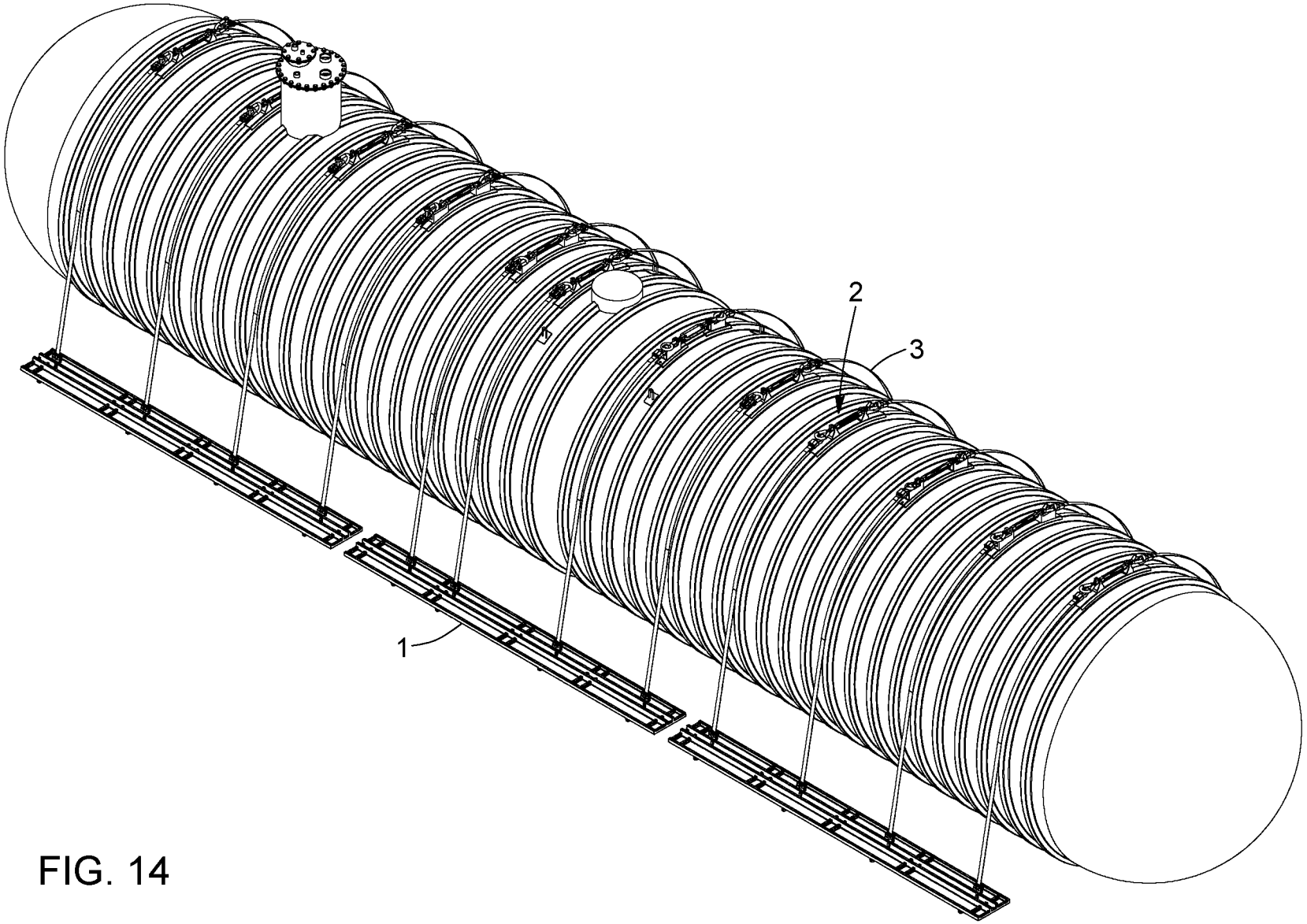
FIG. 14 is a top perspective view of a storage tank of fiberglass-type and having a ribbed surface, the tank being equipped with a plurality of anchoring assemblies according to multiple implementations thereof.
Figure 15:
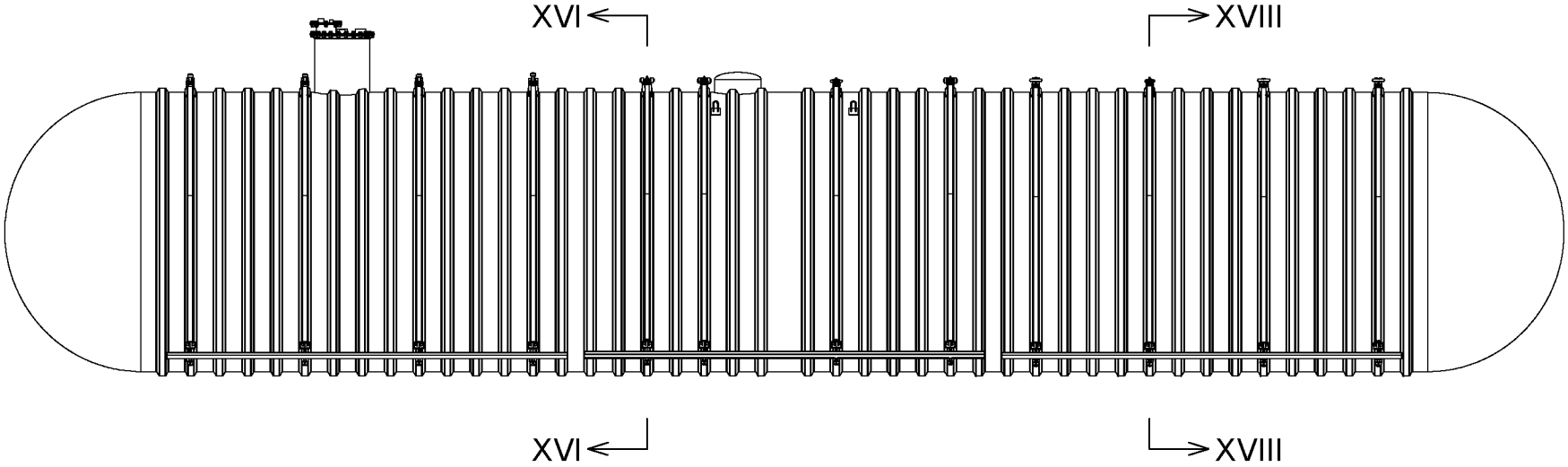
FIG. 15 is a side view of the tank and anchoring assemblies shown in FIG. 14.
Figure 16:
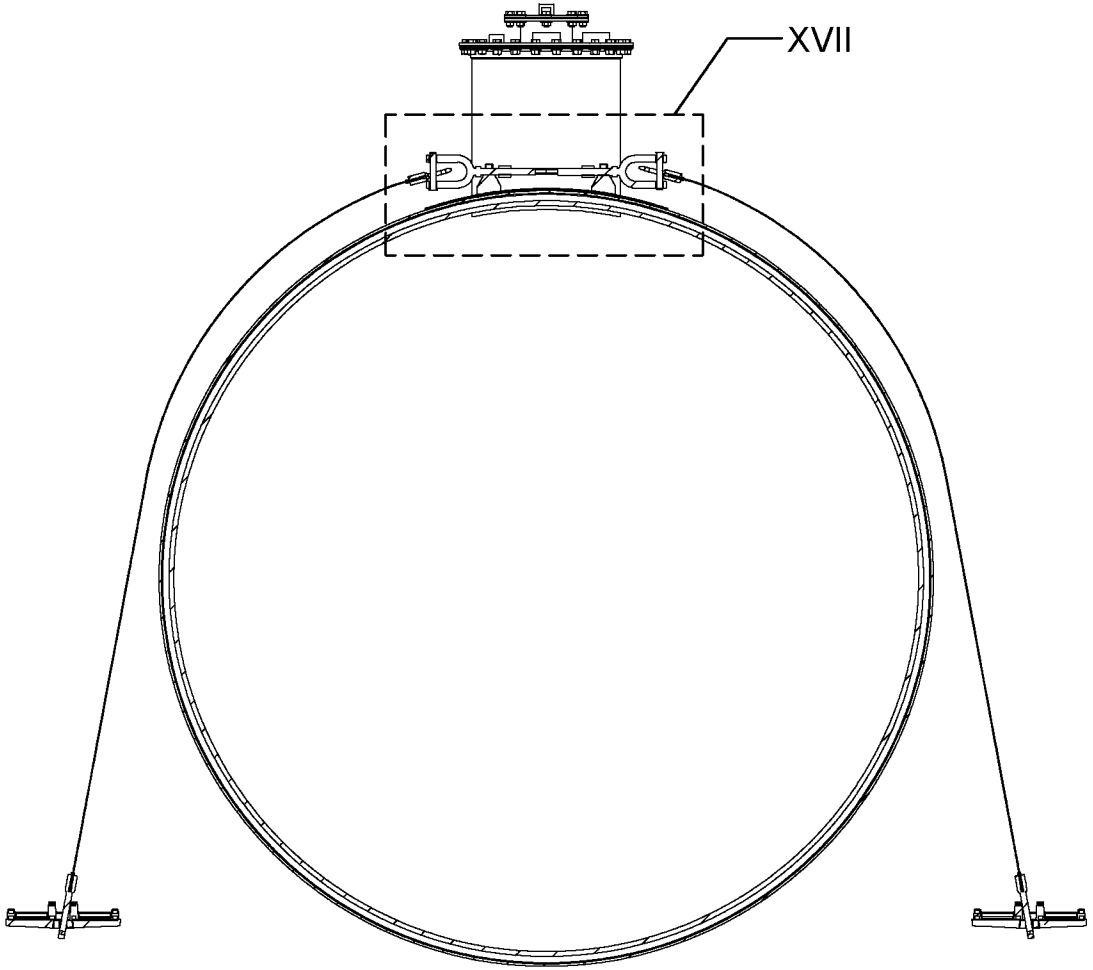
FIG. 16 is a cross-sectional view of the tank and anchoring assemblies shown in FIG. 15 along line XVI.
Figure 17:
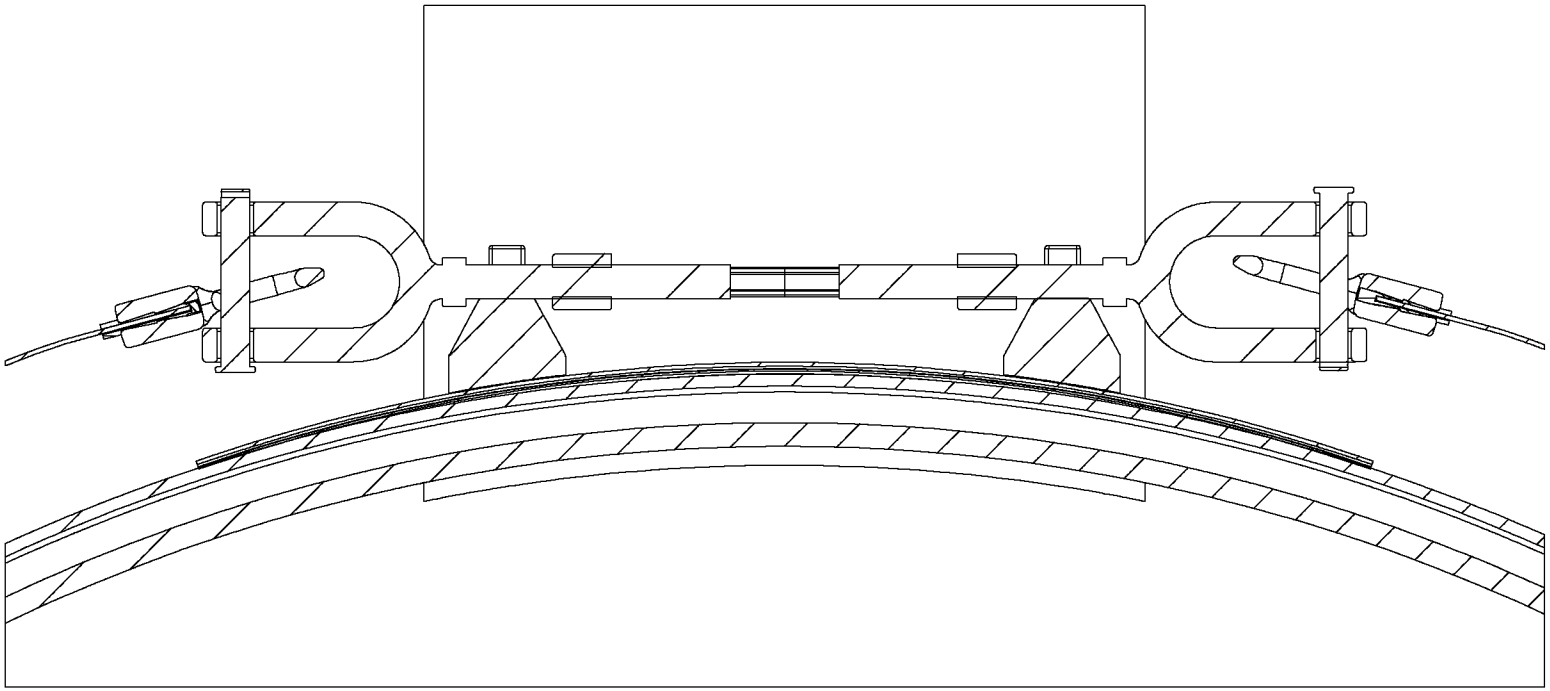
FIG. 17 is a zoomed view of portion XVII of FIG. 16 showing an anchoring assembly securing a pair of opposed straps above a top surface of the tank.
Figure 18:
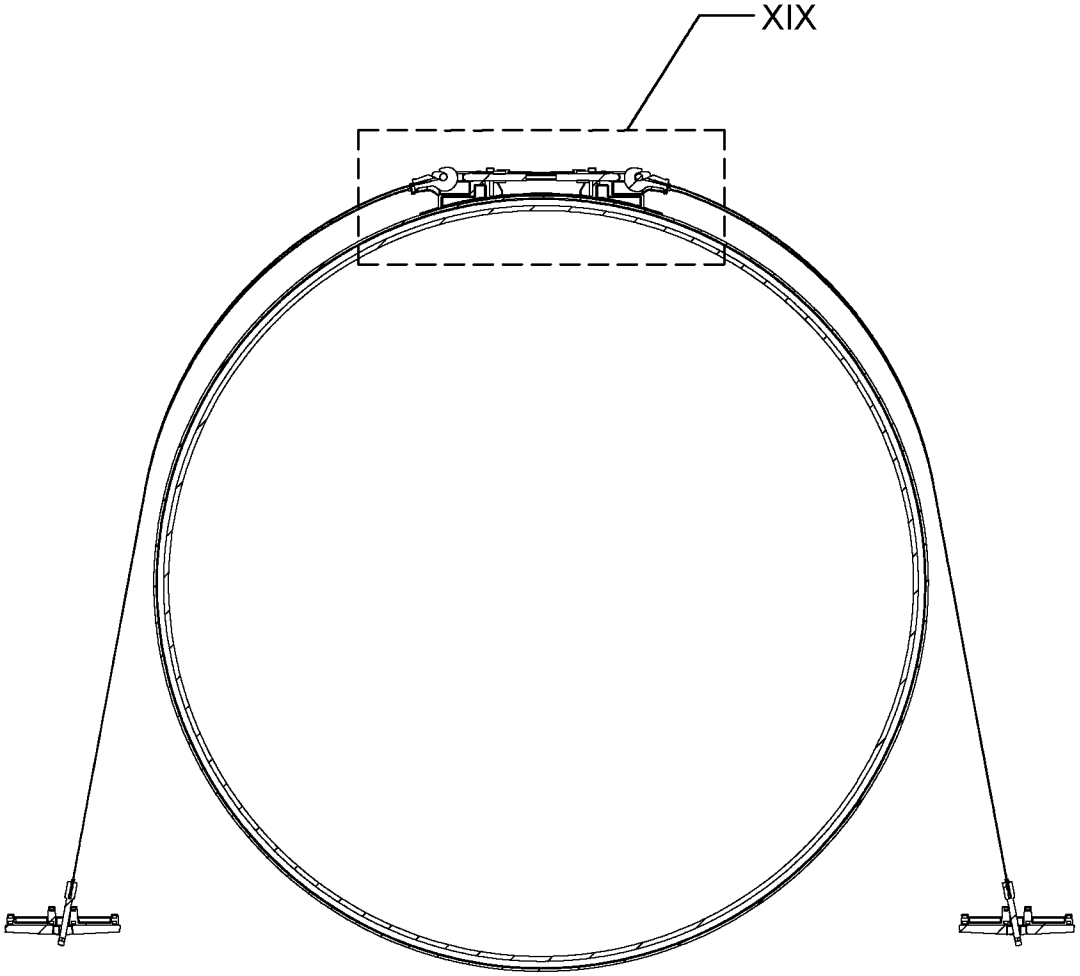
FIG. 18 is another cross-sectional view of the tank and anchoring assemblies shown in FIG. 15 along line XVIII.
Figure 19:
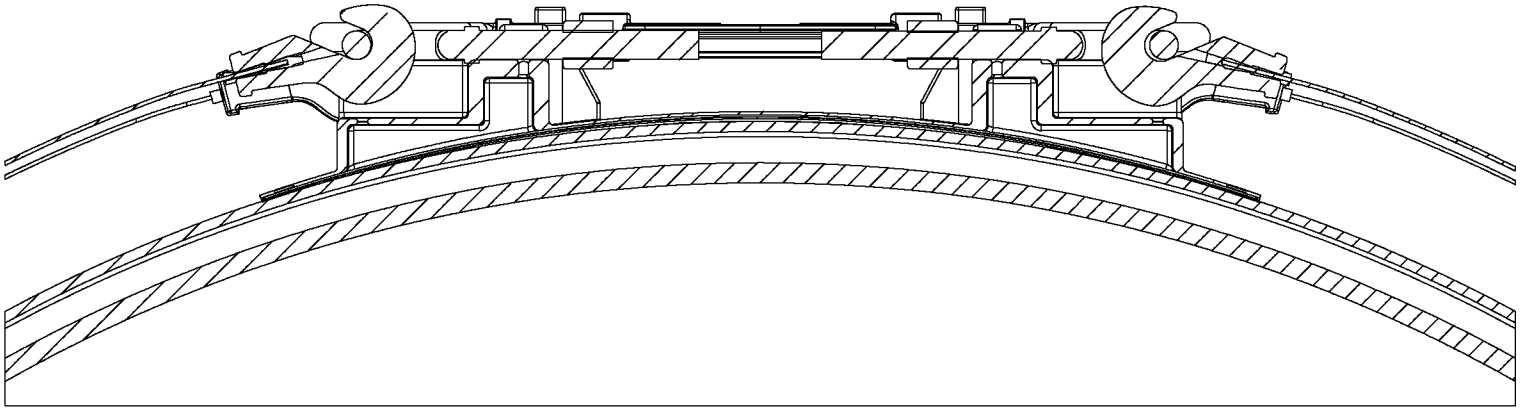
FIG. 19 is a zoomed view of portion XIX of FIG. 18 showing an anchoring assembly securing a pair of opposed straps above a top surface of the tank.

FIGS. 1 and 14 illustrate a storage tank that is held below the ground via several elements including an anchor base 1, an anchoring assembly 2 and a holding strap 3. The holding strap 3 overlies a side of the tank. The anchor base 1 is used to secure a distal end of the holding strap 3 proximal to the ground, and the anchoring assembly 2 is used to secure a proximal end of the holding strap 3 at the top of the tank. The holding strap 3 is a standard holding strap that can include a strap member, at least one hook member and additional elements that are used in the field of straps, such as turnbuckles. The at least one hook member of the holding strap is provided at one end of the strap member. The hook member can be of various shapes, including C-hooks, D-hooks and turnbuckles, and in accordance with the type of connection needed for securing to the anchor base 1 or the anchoring assembly 2.

It should be noted that the proximal end of the holding strap can be used herein to refer to the hook member itself, when the latter is provided at a proximal end of the strap member of the holding strap. For example, when describing that the anchoring assembly 2 is connectable to the proximal end of the holding strap 3, it should be understood that a hook member, secured to the proximal end of the strap member, can be connected to the anchoring assembly 2. The deadman anchor 1 can be a standard concrete base anchor, an anchor as described in the published international patent application WO 2015/143565, or an anchor as described in the provisional U.S. patent application 63/062,108, both applications being incorporated herein by reference.

Figure 4:
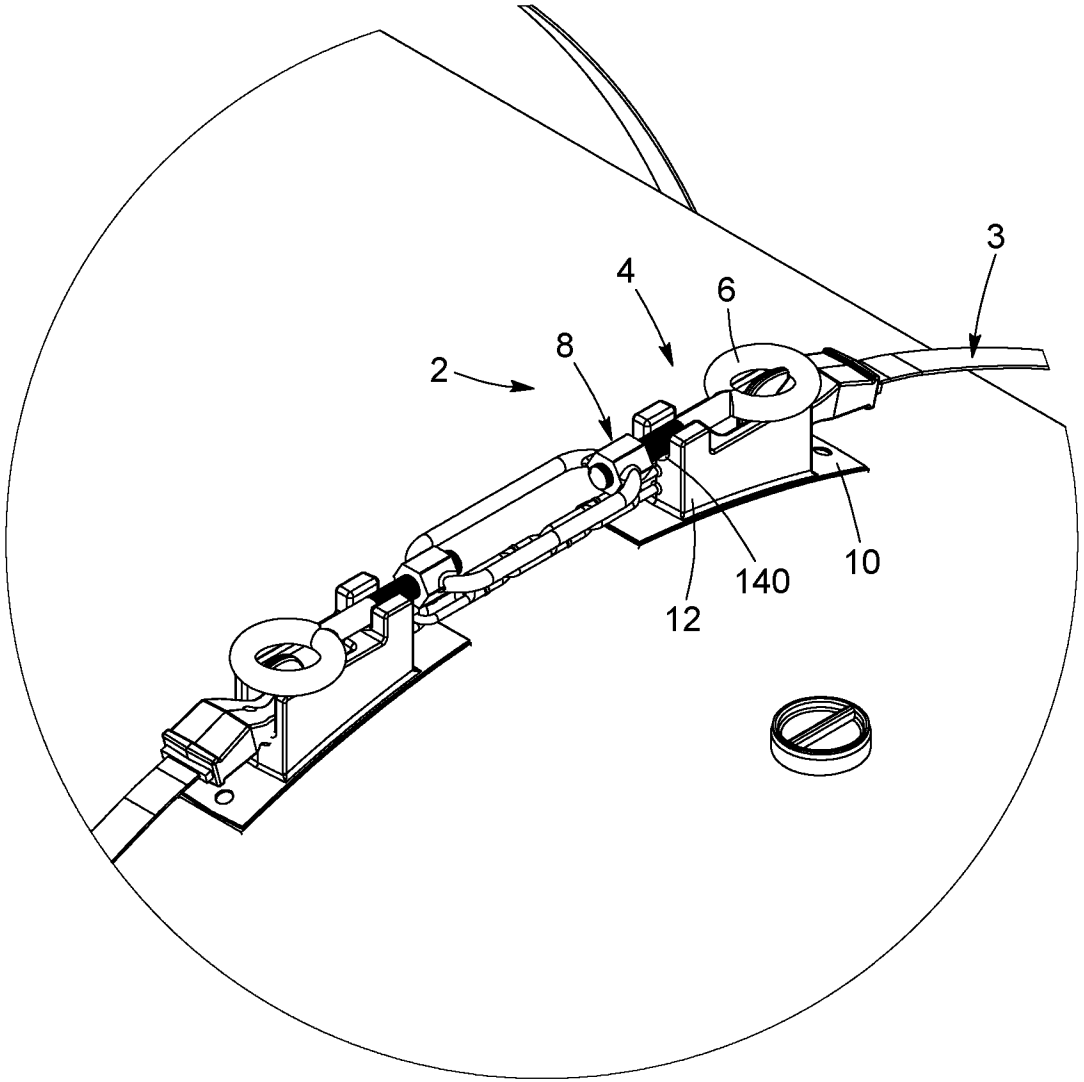
FIG. 4 is zoomed view of a portion of FIG. 1 showing the anchoring assembly according to yet another example implementation.

Referring to an example implementation as illustrated in FIG. 4, the anchoring assembly 2 as proposed herein is installed on the tank for securing the holding strap 3 at the top of the tank, and further tighten the strap member of the holding strap 3 once secured to the anchoring assembly 2. More specifically, the anchoring assembly 2 comprises an anchor 4 that is configured to provide anchorage to the holding strap 3, and a base 5 that is configured to receive and position the anchor 4 above the top of the tank, thereby offering the corresponding anchor 4 of the assembly 2 as anchorage point for the holding strap 3. The anchor 4 is secured to the base 5 so as to be positionable in a transverse direction of the storage tank, in general alignment with the tightened holding straps. Secured can be understood as reversibly connectable to an element of the base, such that the anchor can be held or be supported by the base without preventing the anchor from moving with respect to the surface of the storage tank. Several examples of base design are provided further below to illustrate such connection of the anchor to the base.

Although implementations of the anchoring assembly can be described herein with respect to a base and an anchor, it should be noted that the anchoring assembly can include at least one anchor and at least one base. For example, the Figures illustrate various implementations of an anchoring assembly including a first anchor and a second anchor being connected via an elongated member so as to form a typical turnbuckle. The anchoring assembly further includes a first base and a second base, each one of the first base and second base supporting a corresponding anchor of the turnbuckle.

In another aspect, there is provided a harness assembly including the anchoring assembly as defined herein and at least one holding strap. In some implementations, the anchor assembly can include two hook components to secure a pair of opposed holding straps that can be provided in the harness assembly.

Anchor Implementations

Referring to FIG. 4, the anchor 4 includes a hook component 6 that is configured to engage the proximal end of the holding strap 3, e.g., the hook member of the holding strap 3. The hook component 6 can be shaped to define a loop through which the hook member of the holding strap 3 is inserted for securing thereof.

FIGS. 2 to 4, 21, 25, 30, 35, 46 and 54 shows different examples of the multiple possible implementations of the hook component (6, 6*a*, 6*b*) that can be connected to the hook member of the holding strap 3. For example, FIG. 4 exemplifies an eye-type hook component 6 that provides anchorage to a C-hook member of the holding strap 3 at each side of the tank. It should be noted that the type and configuration of the hook component that is encompassed herein are not limited to the type and configuration illustrated in the Figures, and can include various types and configurations of known hook components for securing holding straps. In some implementations, the hook component can be configured to engage a hook member being a D-hook, a 90-degree D hook, or a C-hook that defines the one end of the holding strap. In some implementations, the hook component can be an O-ring, a D-hook, a 90-degree D hook, or a C-hook. A 90-degree hook refers to a D-hook that is positioned with respect to the base of the anchoring assembly with a 90-degree angle, as seen for example in FIG. 36. In some implementations the hook member of the holding strap can include at least one hooking aid member as described in U.S. Pat. No. 9,228,606, that is incorporated herein by reference.

Still referring to FIG. 4, the anchor 5 further includes a tightening mechanism 8 that is connected to the hook component 6 and that is actuable to adjust a tension of the holding strap 3 when secured to the hook component 6. The hook component can be connected directly or indirectly to the tightening mechanism in various ways.

Figure 5:
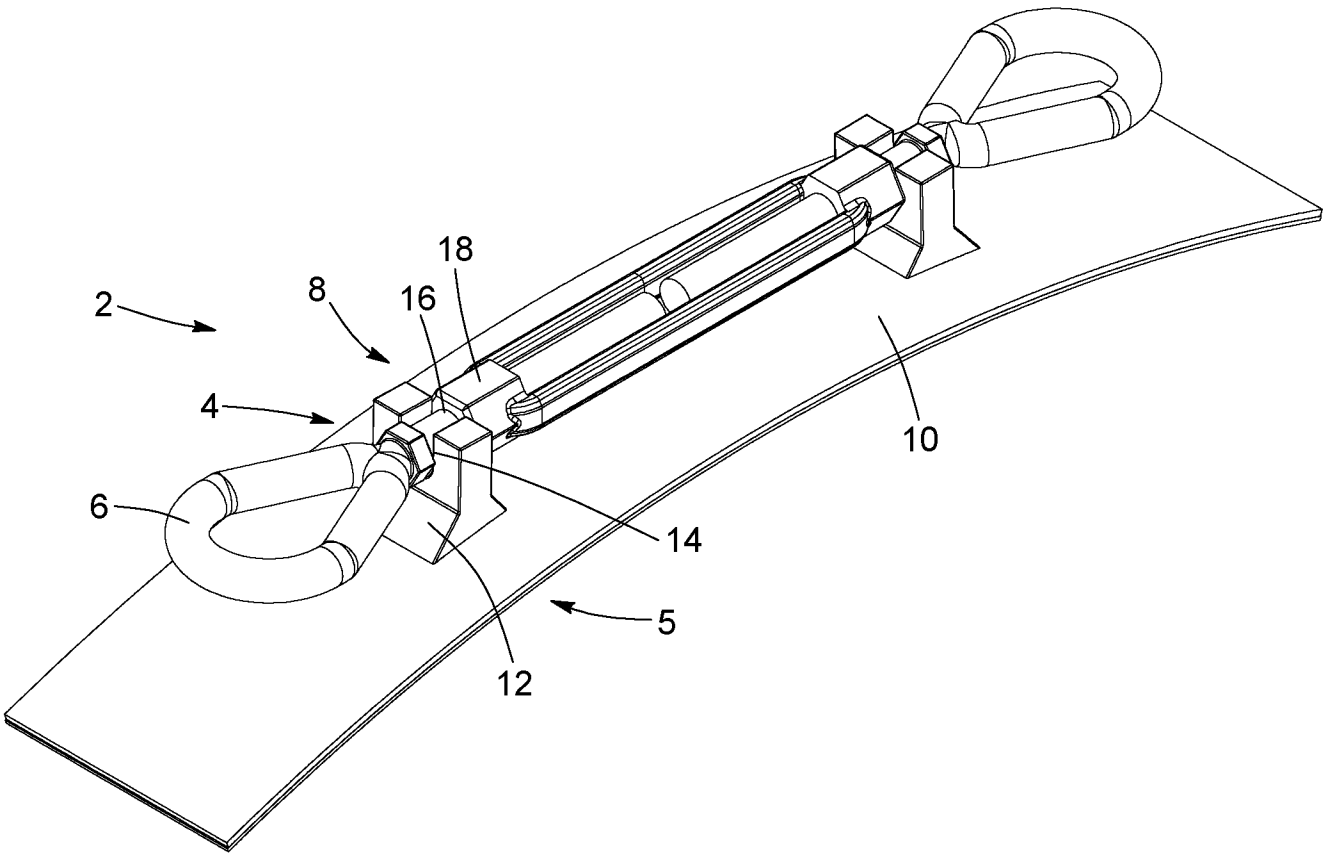
FIG. 5 is a top perspective view of the anchoring assembly according to yet another example implementation, and including two anchors to form a turnbuckle.

Referring to the implementation illustrated in FIG. 5, the tightening mechanism 8 includes a travelling member 16 being operatively connected to the hook component 6, and a rotating member 18 that is cooperating with the travelling member 16 to move the hook component 6 with respect to the base 5 (and with respect to the top surface of the storage tank), thereby modifying a tension of the holding strap that is anchored to the hook component 6 of the anchor 4. Once the strap 3 is attached to the hook component 6, it should be noted that the travelling member 16 can be displaced in a transverse direction of the tank along the base 5, but the travelling member 16 is not configured to rotate about a transverse axis. The rotating member 18 is configured to be rotatable about the transverse axis to cause displacement of the travelling member 16, but the rotating member 18 is not configured to be displaceable along the base 5 in the transverse direction.

For example, the hook component can be welded or screwed to a proximal end of the travelling member. In another example, as seen in the illustrated implementations, the hook component 6 forms a one-piece structure with the travelling member 16. Referring to FIG. 5, the travelling member 16 can be integrally cast along with the hook component 6. The travelling member 16 is further received within the rotating member 18.

Figure 46:
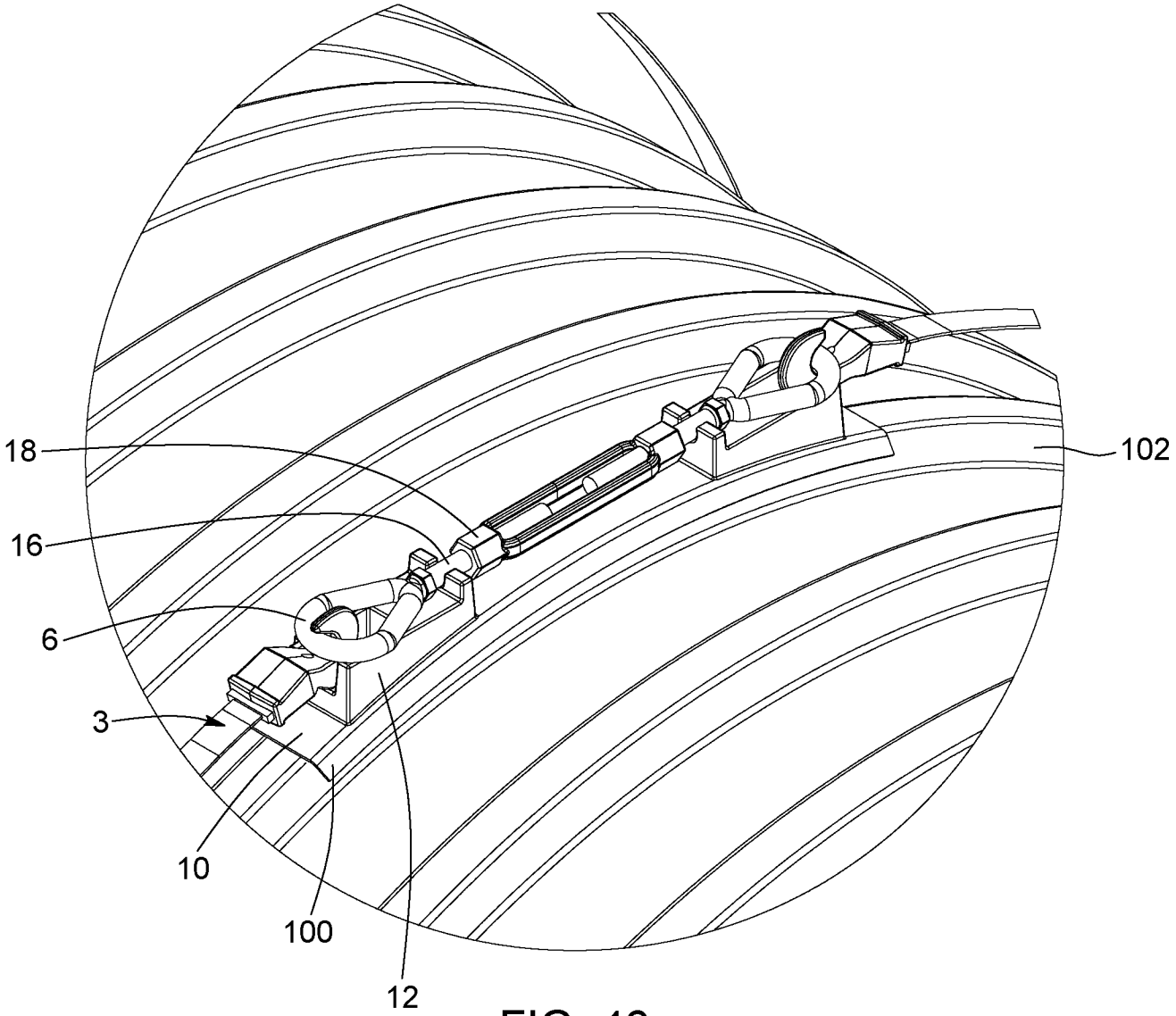
FIG. 46 is a zoomed view of another portion shown in FIG. 14, the anchor assembly providing anchorage and tightening to a pair of opposed straps above the tank.

It should be noted that the tightening mechanism is considered as being "supported" by the base when at least one element to the tightening mechanism is held, directly or indirectly, via the base. For example, the rotating member 18 can be said to be supported by the base 5 when the travelling member 16 is received in a recess 14 of the base 5 and further engaged into the rotating member 18. The rotating member 18 can abut the base 5 as seen in FIG. 5, or can be spaced apart from the base 5 as seen in FIG. 46.

In some implementations, the tightening mechanism of the anchor assembly can include a pair of opposed travelling members, translation of which is actuated via one single rotating member, so as to adjust the tension of the pair of opposed holding straps.

Figure 6:
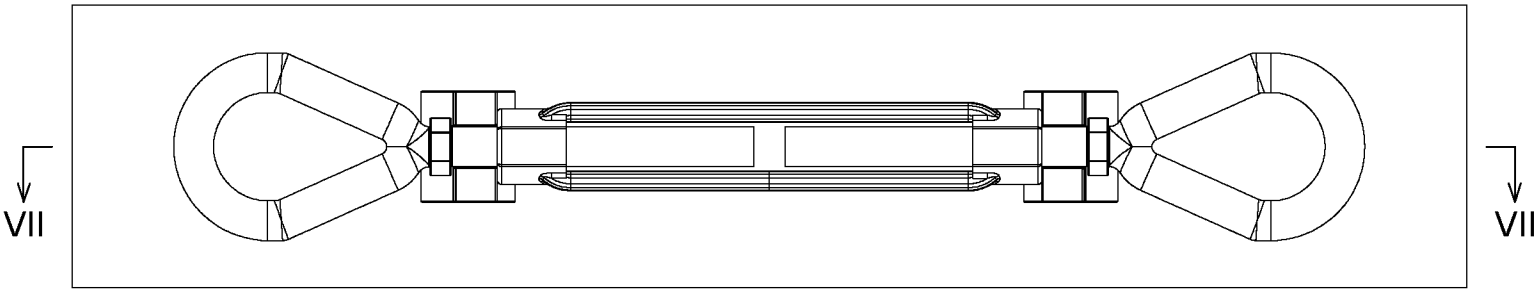
FIG. 6 is a top view of the anchoring assembly shown in FIG. 5.
Figure 7:
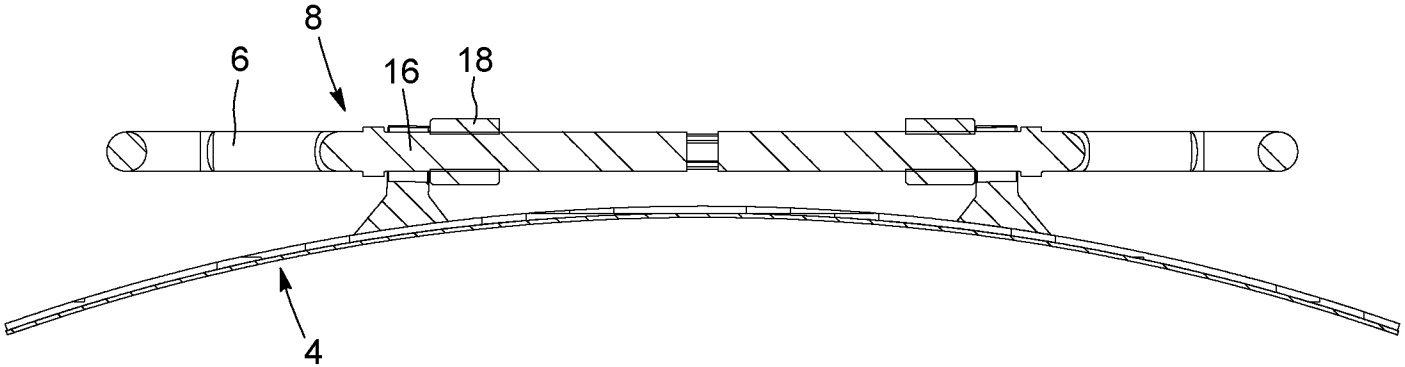
FIG. 7 is a cross-sectional view of the anchoring assembly shown in FIG. 5 along line VII.
Figure 9:
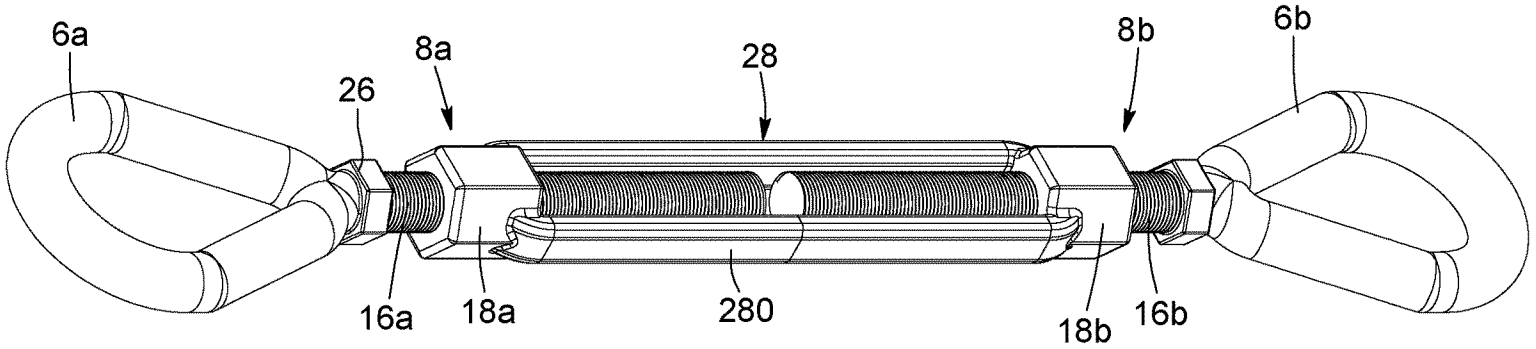
FIG. 9 is a top perspective view of a pair of anchors that are joined by an elongated connecting body according to an implementation of the anchoring assembly, with each anchor comprising a hook component and a tightening mechanism.
Figure 10:
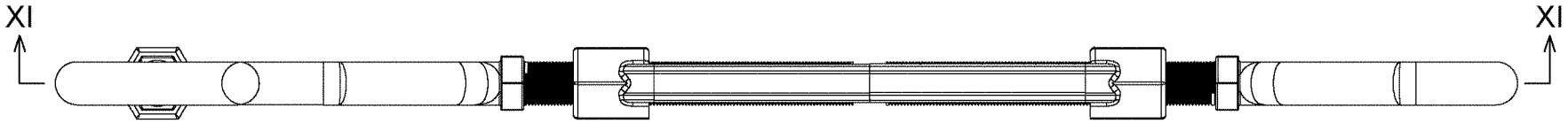
FIG. 10 is a side view of the assembly shown in FIG. 9.
Figure 11:
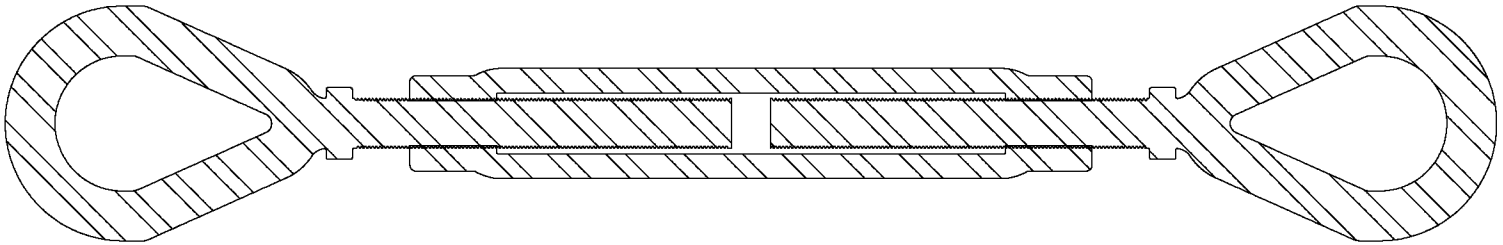
FIG. 11 is a cross-sectional view of the assembly shown in FIG. 9 along line XI.
Figure 12:
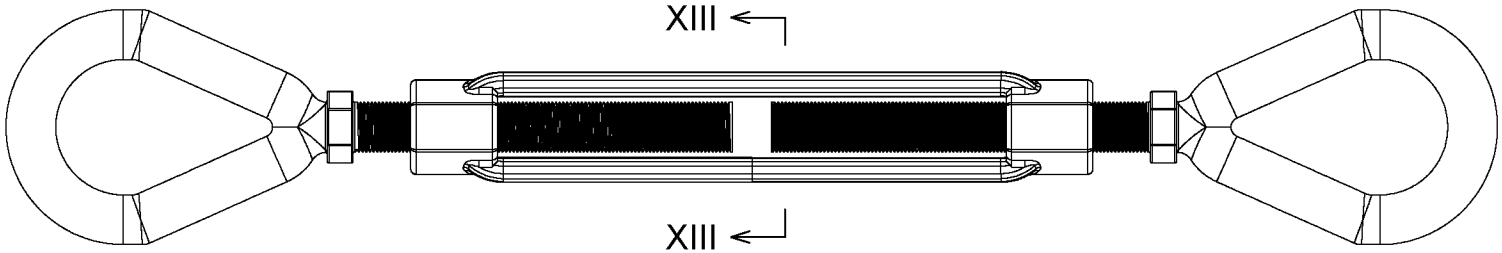
FIG. 12 is a top view of the assembly shown in FIG. 9.
Figure 13:
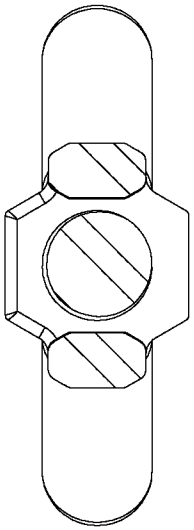
FIG. 13 is a cross-sectional view of the assembly shown in FIG. 9 along line XIII.

Referring to FIG. 7, the travelling member 16 can be a threaded bolt and the rotating member 18 can be a complementary nut that receives the threaded bolt 16, with the threaded bolt 16 being movable with respect to the complementary nut 18 via screwing of the threaded bolt 16. The hook component 6 is said to be connected to or integral with the threaded bolt 16 such that the hook component 6 is displaced along the transverse direction upon clockwise or counter-clockwise rotation of the threaded bolt 16, thereby modifying a tension of the holding strap when secured to the hook component 6. As better seen in FIG. 6, in the implementations shown in the Figures, the hook component 6 and the threaded bolt 16 are moulded as a one-piece structure, such that the tension of the holding strap 3 can be adjusted via rotation of the rotating member, that further leads to the displacement of the threaded bolt 16 with respect to the complementary nut 18. In some implementations, as seen in FIG. 9, the travelling member can comprise the threaded bolt 16 and a secondary nut 26 that is engaged with or integral with a proximal end region of the threaded bolt 16. This secondary nut is optional and can facilitate the installation or maintenance of the travelling member. The secondary nut can for example be placed between the seat member and the rotating member to provide an abutment surface.

Figure 64:
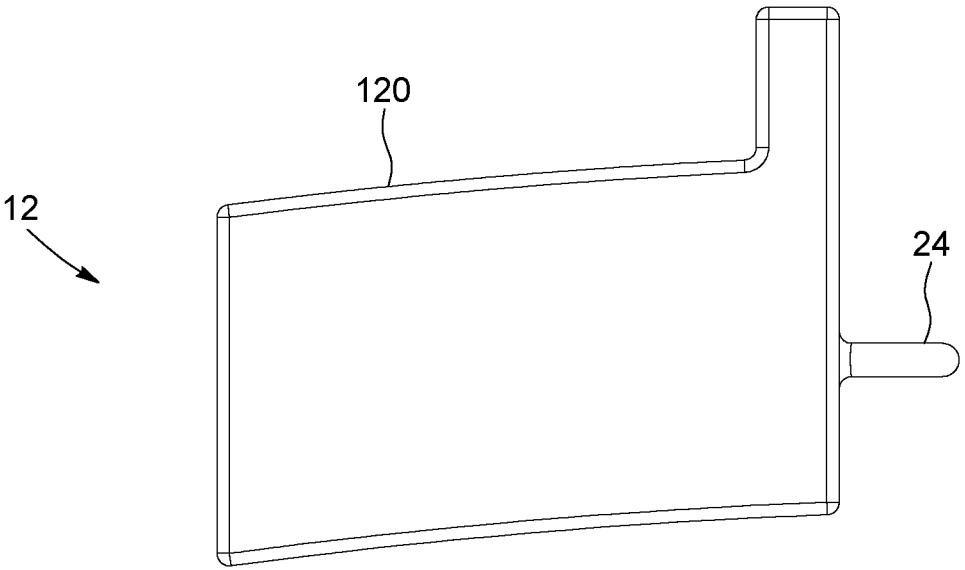
FIG. 64 is a side view of the base shown in FIG. 62.
Figure 66:
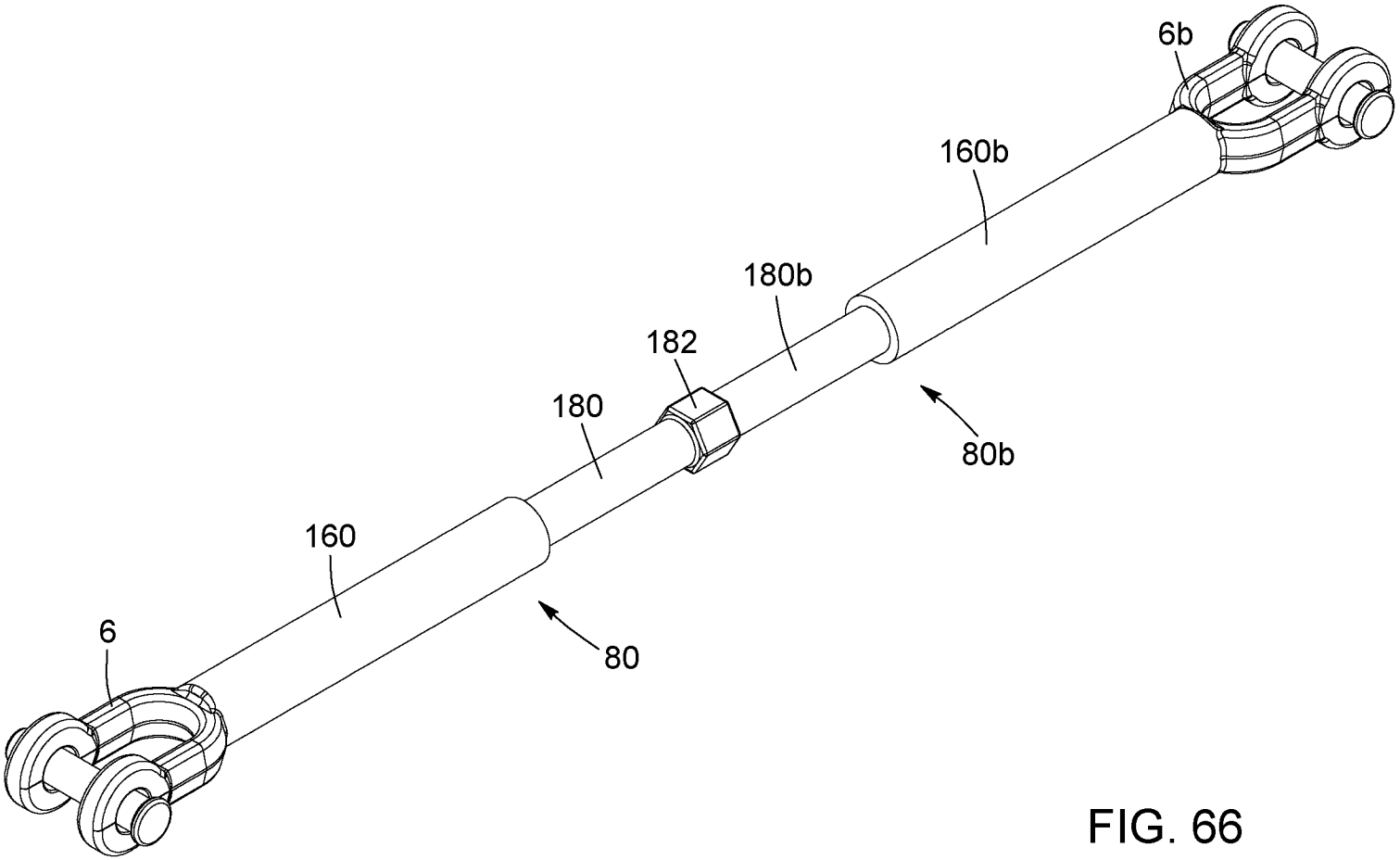
FIG. 66 is a top perspective view of two anchors being joined by a central hexagonal head, and further showing two opposed tightening mechanisms including a bolt as a rotating member.
Figure 67:
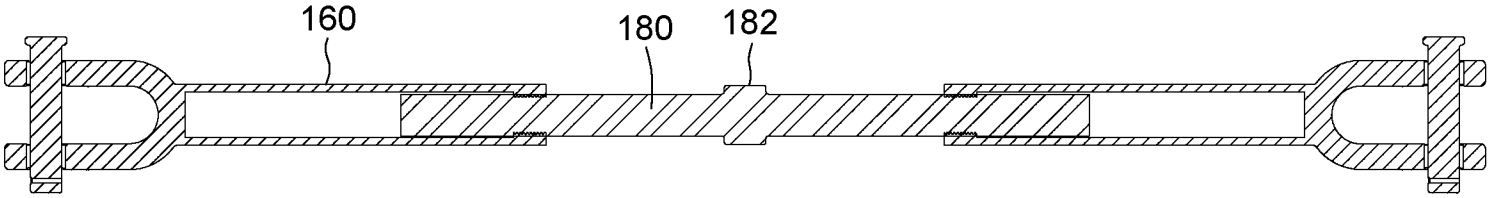
FIG. 67 is a longitudinal cross-sectional view of the assembly shown in FIG. 66.

It should be noted that the implementations of the travelling member and rotating member of the tightening mechanism are not limited to those illustrated in FIGS. 1 to 64. For example, referring to FIG. 66, the tightening mechanism 80 can be designed by including a travelling member 160 which is a threaded bore, and a rotating member 180 which is a complementary threaded bolt. The rotating member 180 is thus inserted into the travelling member 160 that serves as a "nut" bore. Rotation of the rotating member 180 actuates the translation of the travelling member 160. The threaded bolt can include a head 182 that can be latched on for rotation of the threaded bolt into the translating bore. The head 182 can be used to join another opposed tightening mechanism 80*b*, such that the anchor assembly further includes a second travelling member 160*b* and a second rotating member 180*b* for translation of the related hook component 6*b*. As better seen in FIG. 67, the head 182 can be cast as a one-piece structure with the rotating member 180.

Although the anchor can be described in connection with one hook component and one tightening mechanism, it should be noted that the anchor as encompassed herein can be defined as further including a second hook component and a second tightening mechanism to secure another holding strap on an opposed side of the storage tank. For example, referring to FIG. 5, a turnbuckle can be used as the anchor 4 that is secured to the base 5. Alternatively, the anchoring assembly as encompassed herein can be defined as including at least one anchor being as defined herein. The at least one anchor can include a first anchor and a second anchor, each anchor being used to secure another holding strap at an opposed side of the storage tank.

As seen in the implementations shown in the Figures, the second anchor can be sized and configured similarly to the first anchor. For example, the hook component of the second anchor can be sized and configured similarly to the hook component of the first anchor. For example, the tightening mechanism of the second anchor can be sized and configured similarly to the tightening mechanism of the first anchor. However, it should be noted that the tightening mechanism of the first anchor that adjusts a tension of the holding strap at one side of the tank can be different in terms of size and/or structure than the tightening mechanism of the second anchor that is used to adjust a tension of the holding strap on the other side of the tank.

Figure 65:
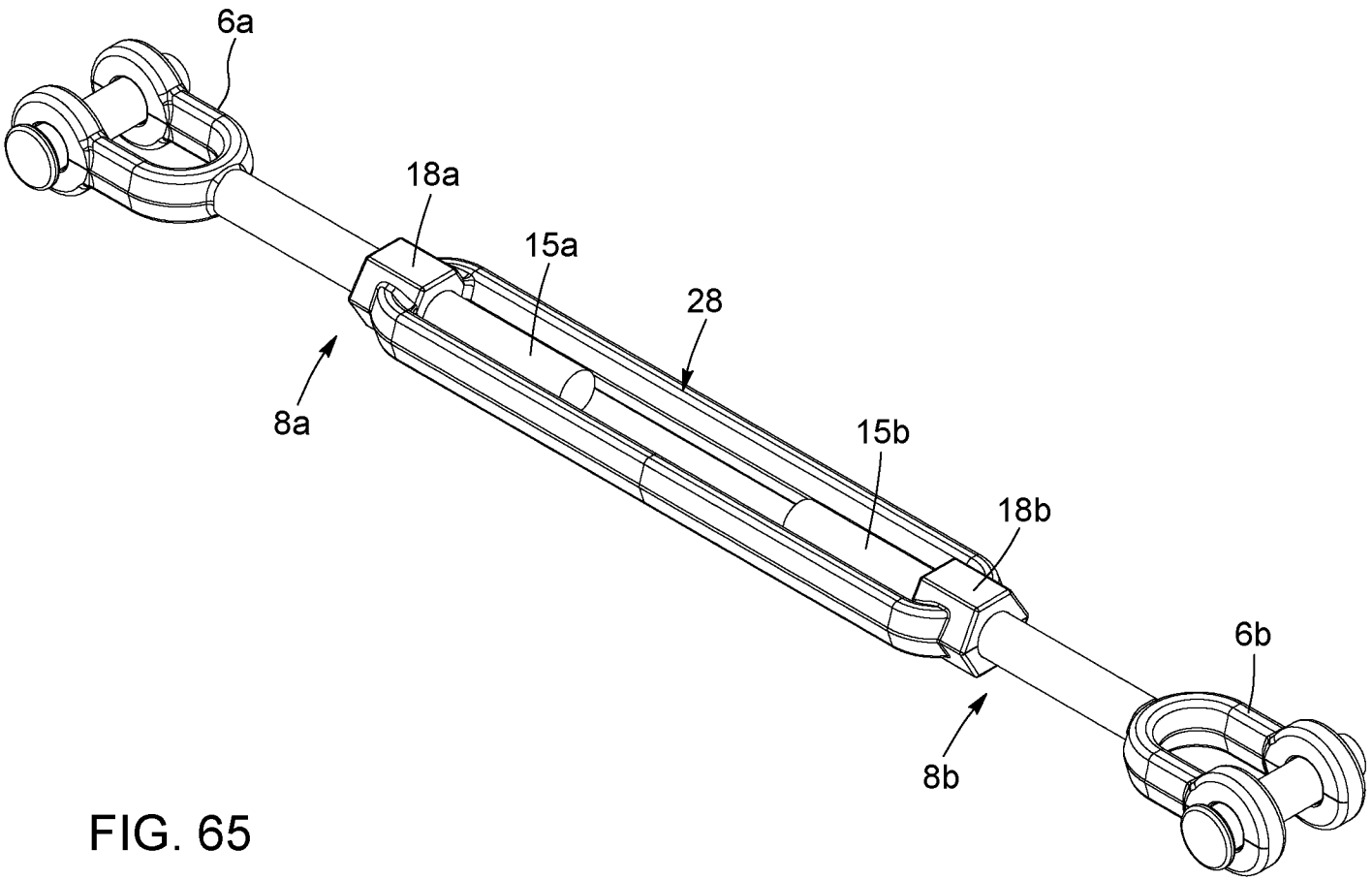
FIG. 65 is a top perspective view of two anchors joined by the elongated body shown in FIG. 61.

As seen in the illustrated implementations, the first and second anchors can be connected to one another via an elongated connecting body. Referring to FIG. 9 or FIG. 65, the rotating members 18*a* and 18*b* can be linked together via the elongated connecting body 28 that is hollow to further receive a distal portion of each travelling member 16*a*, 16*b* when each travelling member 16*a*, 16*b* is inserted in the corresponding rotating member 18*a* or 18*b*. The elongated connecting body can be made integrally with the first and second rotating members 18*a* and 18*b*.

Figure 31:
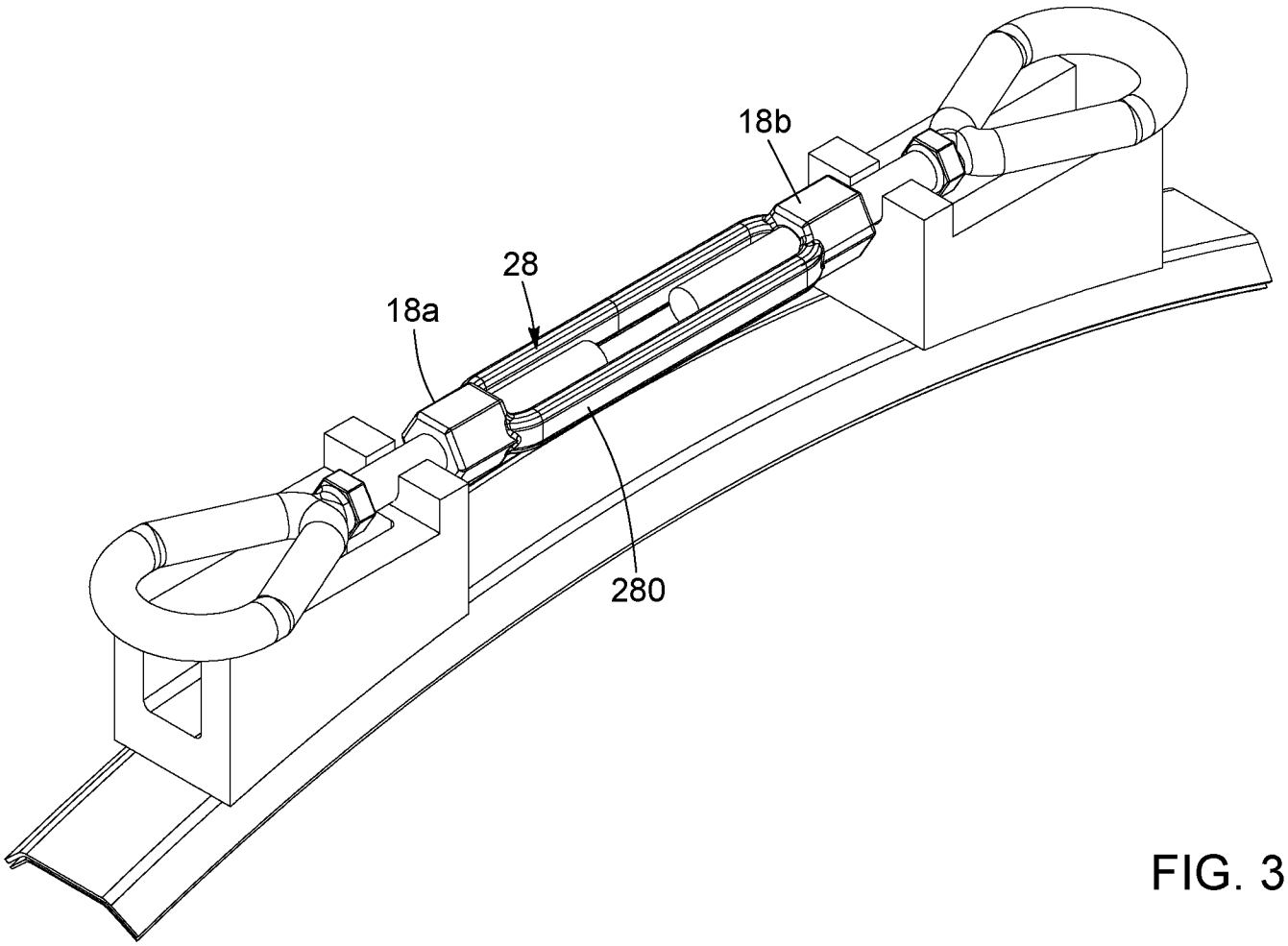
FIG. 31 is a top perspective view of the anchoring assembly shown in FIG. 30.
Figure 32:
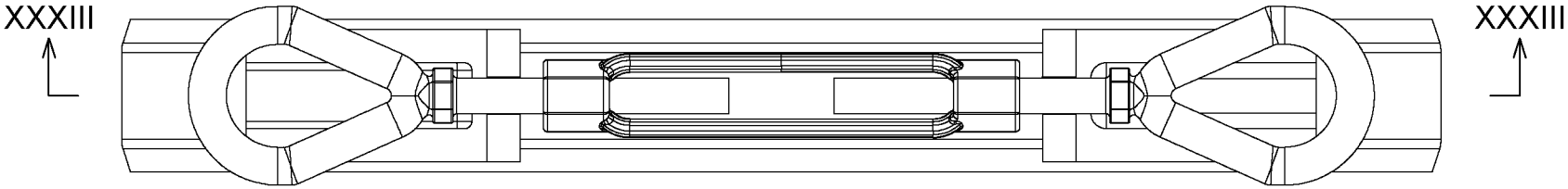
FIG. 32 is a top view of the anchoring assembly shown in FIG. 30.
Figure 33:
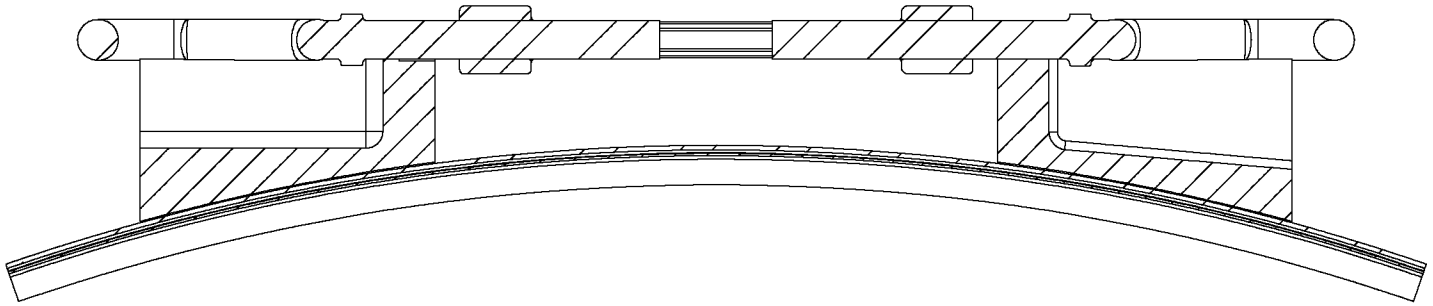
FIG. 33 is a cross-sectional view of the anchoring assembly shown in FIG. 32 along line XXXIII.
Figure 34:
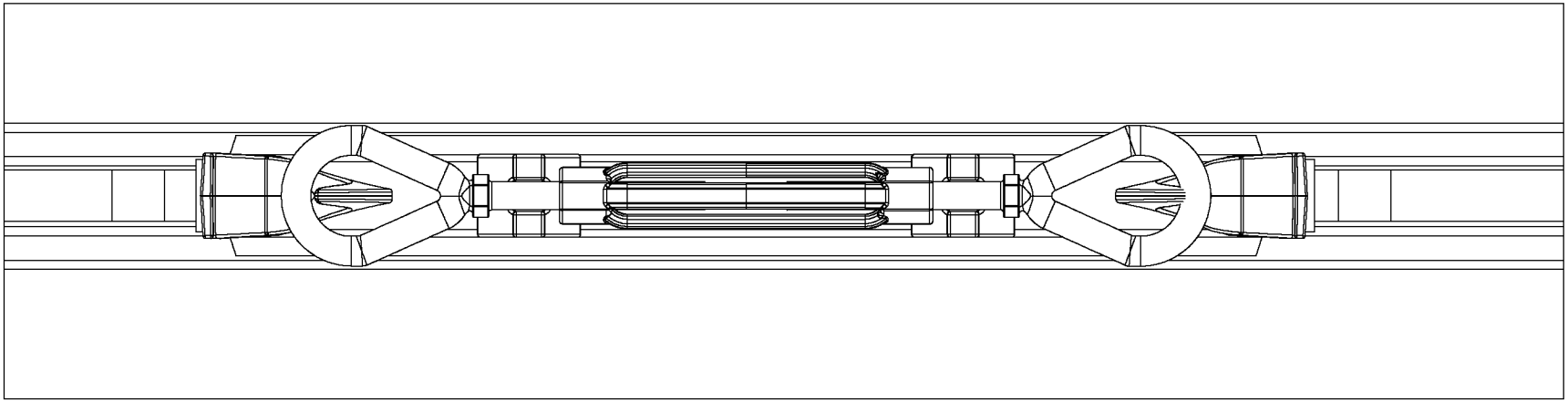
FIG. 34 a top view of the anchoring assembly shown in FIG. 30, when installed on the top surface of the storage tank and when secured to a pair of opposed holding strap, each seat member accommodating the hook member of each holding strap.
Figure 61:
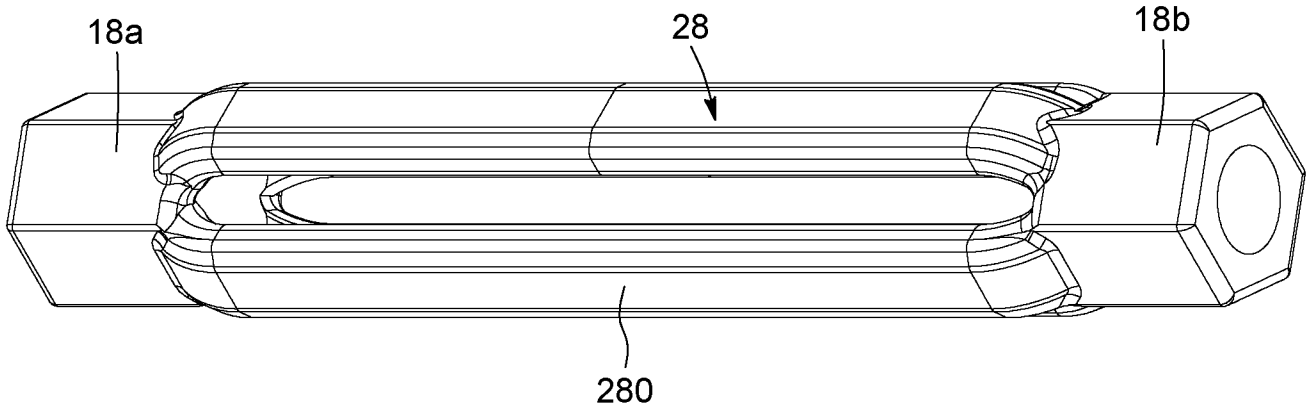
FIG. 61 is a side perspective view of an example implementation of an elongated body for joining two opposed rotating members and forming a rotating assembly for actuation of two opposed travelling members of the anchoring assembly.

When the two anchors of the anchoring assembly are connected via the elongated connecting body, rotation of the first rotating member 18*a* further rotates the second rotating member 18*b* via the elongated connecting body, such that both opposed holding straps can be tightened simultaneously. As seen in FIGS. 9, 31 and 61 for example, the elongated connecting body 28 can be an open body, such as including three or four ribs 280 joining the rotating members. Alternatively, the elongated connecting body can be a closed body. In some implementations, the elongated connecting body can be a gutter or a bore.

Base Implementations

The base of the anchor assembly receives the anchor for securing a holding strap on at least one side of the storage tank.

Referring to the implementation of FIG. 4, the base 5 can include a sole member 10 having a lower surface that is connected to the top surface of the storage tank. The base 5 further includes a seat member 12 extending upwardly from an upper surface of the sole member 10 and that is configured to cooperate with the tightening mechanism 8 so as to support the anchor 4 to the base 5.

Although certain Figures show implementations of the base including a sole member, it should be understood that the base of the anchoring assembly can include the seat member resting on the top surface of the storage tank without any sole member there between. In some implementations, the material of the base can be chosen to obtain a tailored friction coefficient that allows controlled sliding of the base with respect to the top surface of the tank. In other implementations, the base can be secured to the top surface of the tank such that the base is not able to slide with respect to the top surface of the tank. The sole member and/or the seat member of the base can be shaped to accommodate the contours of the top surface of the storage tank.

Figure 8:
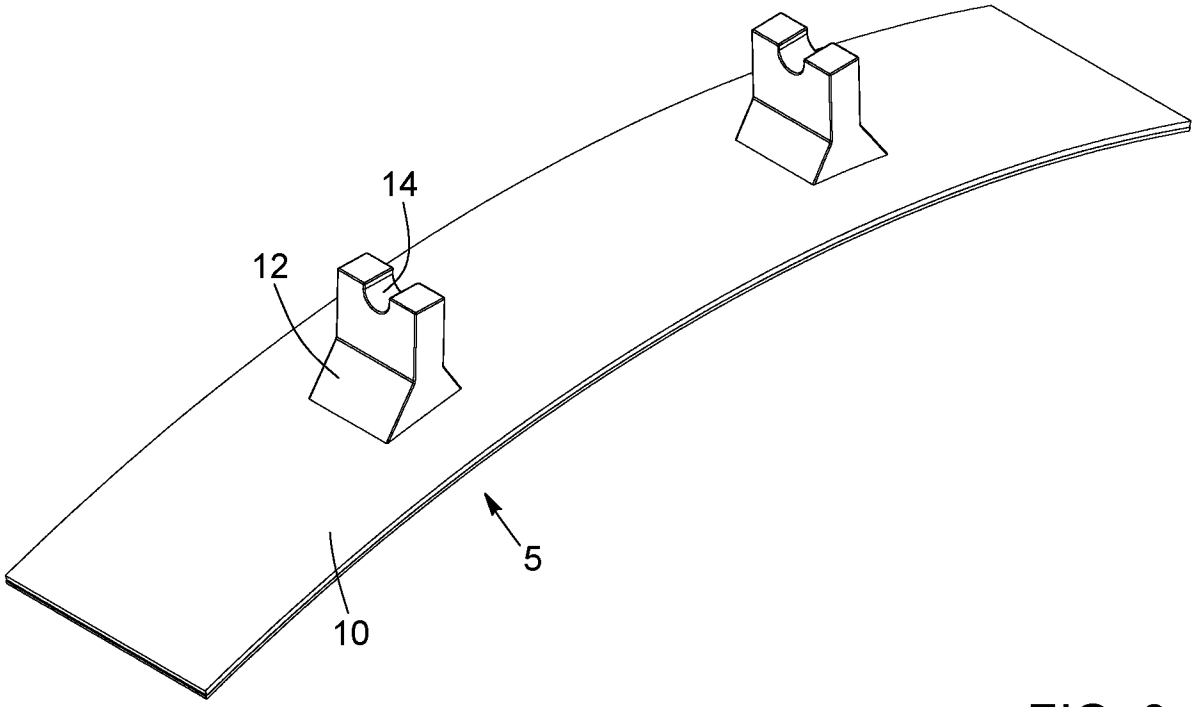
FIG. 8 is a top perspective view of a pair of seat members that are joined by a sole member according to an implementation of the anchoring assembly.
Figure 54:
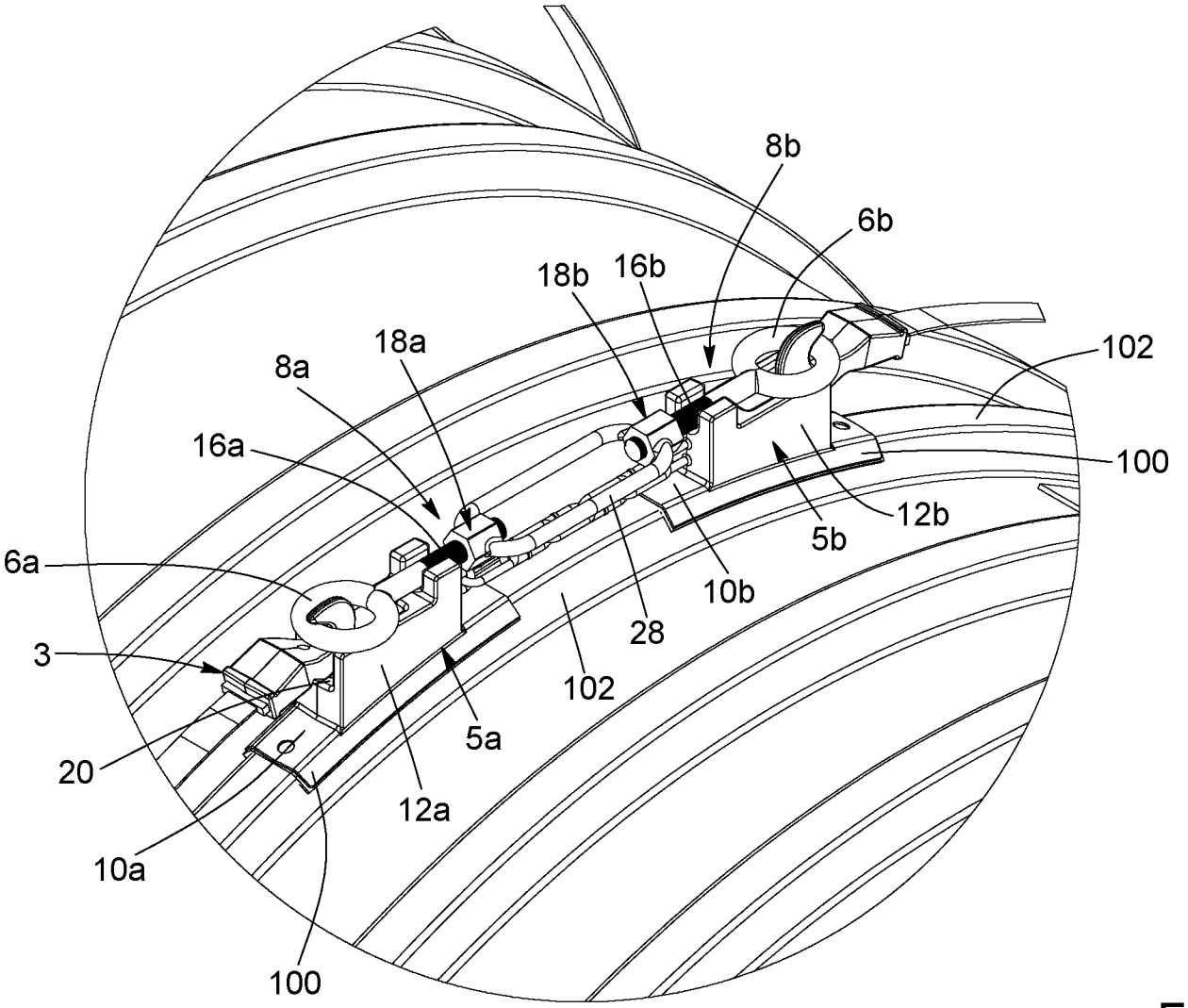
FIG. 54 is a zoomed view of another portion of FIG. 14, the anchoring assembly providing anchorage and tightening to a pair of opposed straps above the tank.
Figure 55:
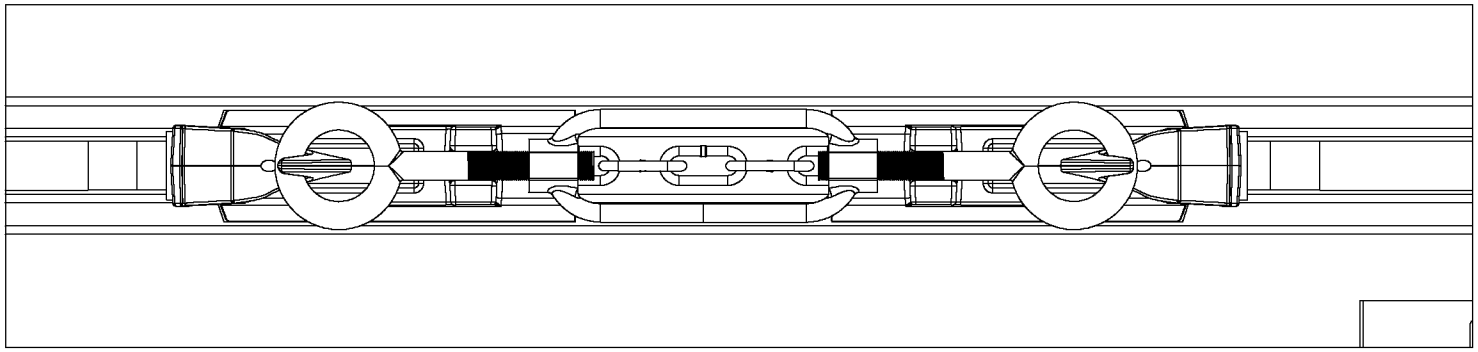
FIG. 55 is a top view of the anchoring assembly shown in FIG. 54.
Figure 56:
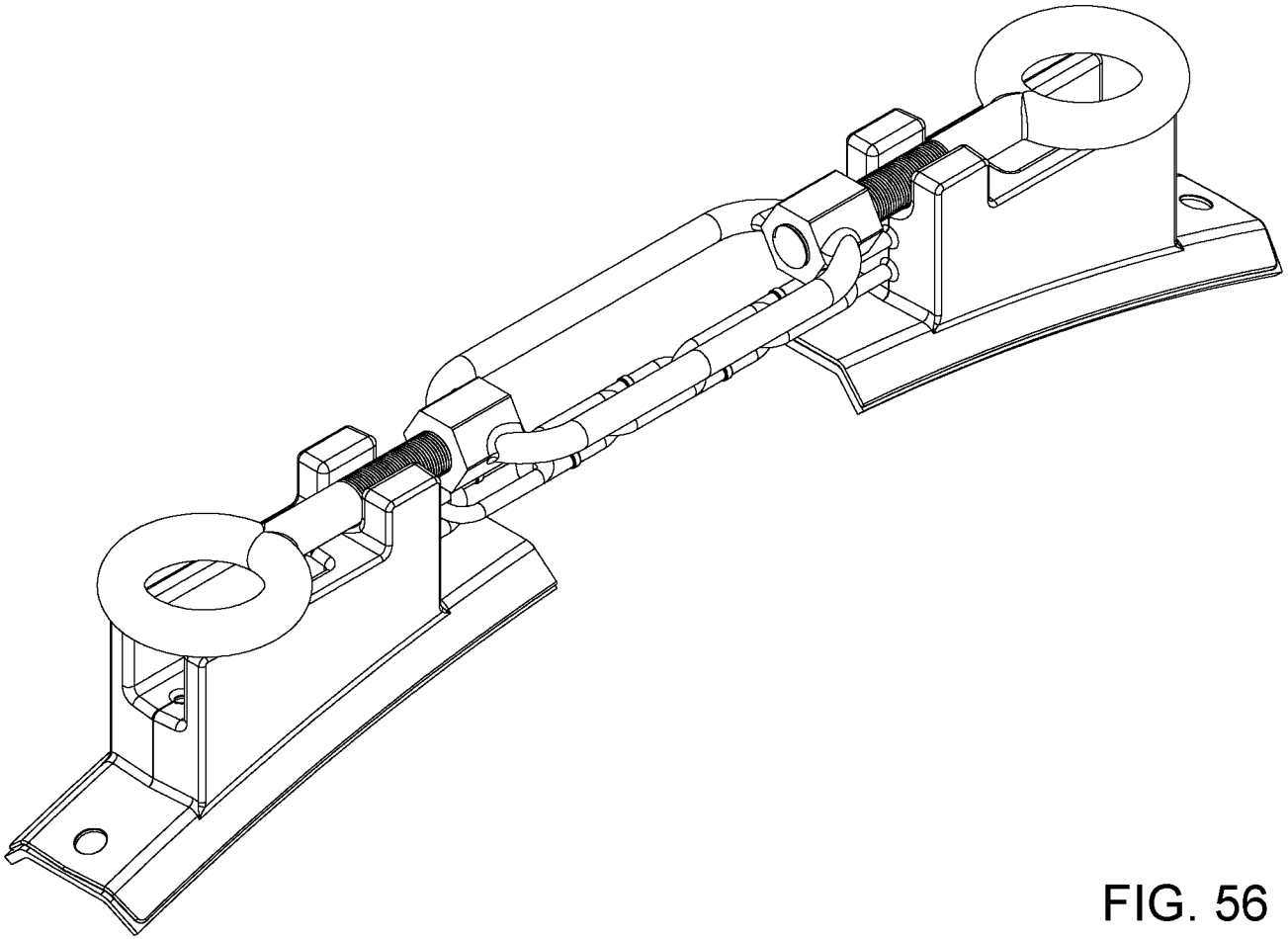
FIG. 56 is a top perspective view of the anchoring assembly shown in FIG. 54.
Figure 57:
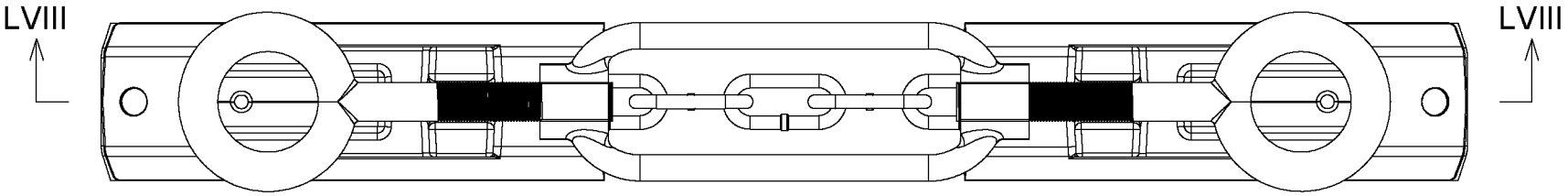
FIG. 57 is a top view of the anchoring assembly shown in FIG. 56.

FIGS. 4 and 8 show an implementation where the sole member 10 is arched along a transverse direction of the storage tank to follow a curvature of the top surface of the tank (e.g., a metallic UST having a substantially flat and rounded surface). FIGS. 46 and 54, show another implementation where the sole member 10 can further include two opposed bent edge portions 100 for installation of the base on a rib 102 of the storage tank (e.g., a fiberglass UST). The sole member 10 can be directly secured on top of the tank via welding, screwing, or gluing. Depending on the material of the sole member 10, the latter can be secured via friction in response to the downward mechanical constraint imposed by opposed straps. The material of the sole member 10 can be chosen to offer increased friction with the surface of the tank, thereby allowing mechanical adhesion of the sole to the surface of the tank. For example, the sole member (or seat member) or at least a bottom surface thereof can be made of rubber, silicone, urethane or elastomer. In another example, the sole member or at least a bottom surface thereof can include a particulate material, such as sand to provide an uneven surface or a standard normal surface.

Figure 39:
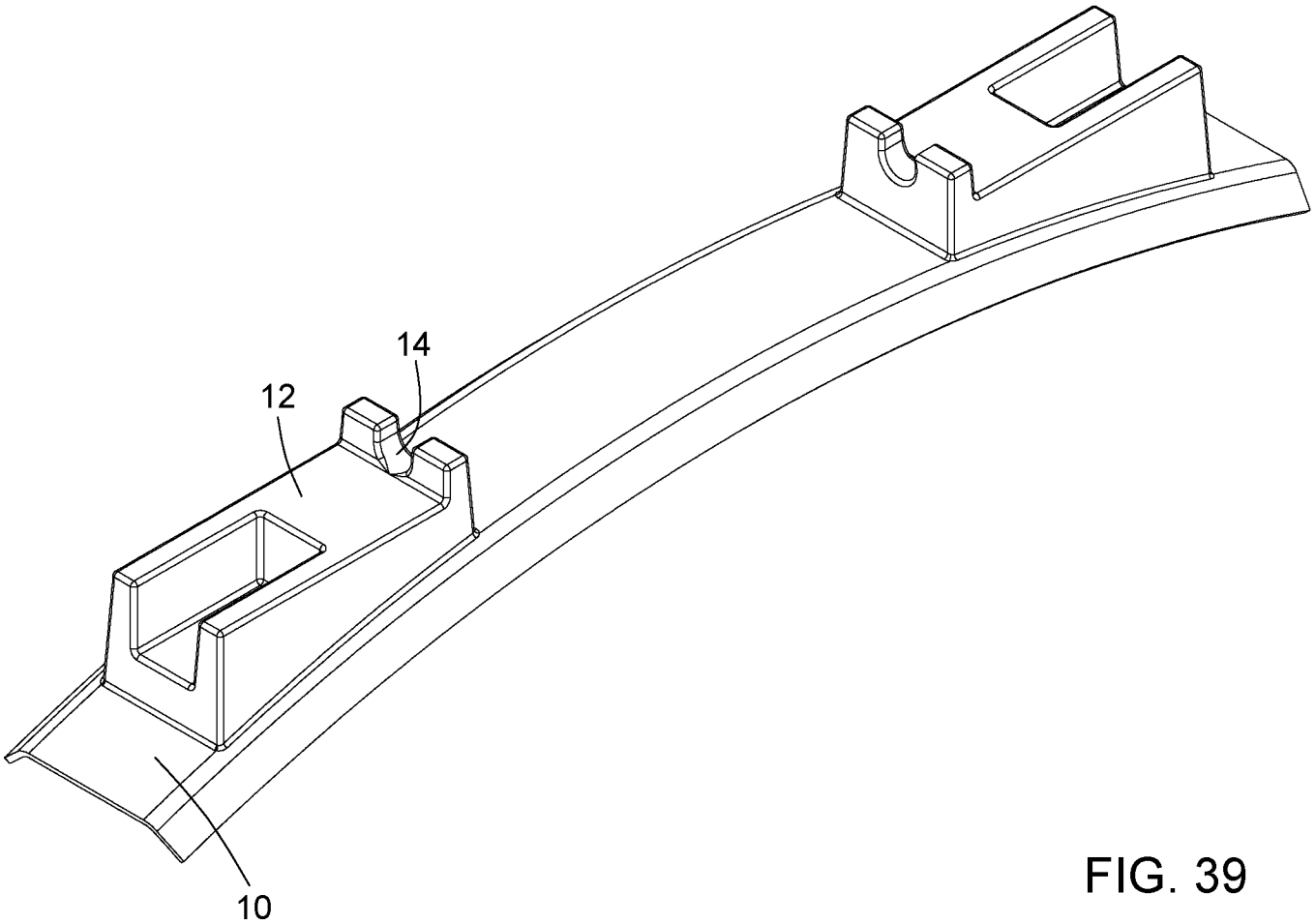
FIG. 39 is a top perspective view of an example implementation of the base of the anchoring assembly.
Figure 40:
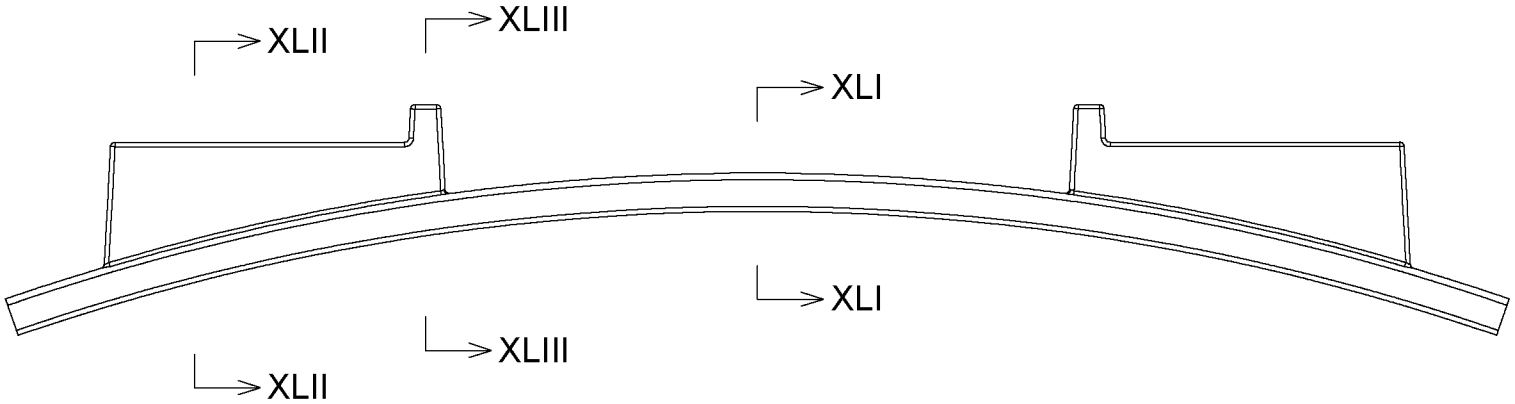
FIG. 40 is a side view of the base shown in FIG. 39.
Figure 41:
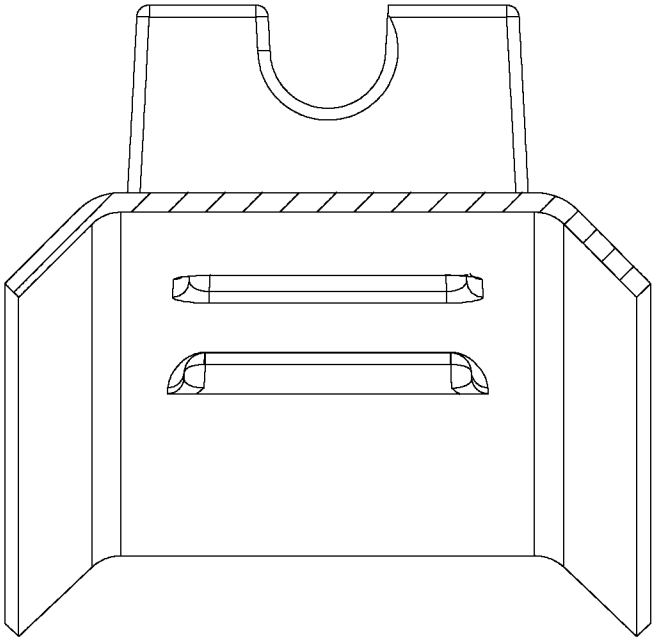
FIG. 41 is a cross-sectional view of the base shown in FIG. 40 along line XLI.
Figure 42:
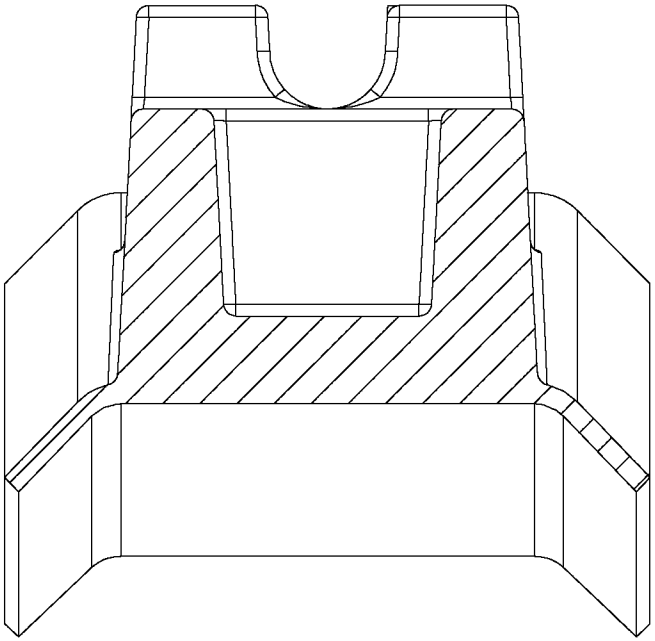
FIG. 42 is a cross-sectional view of the base shown in FIG. 40 along line XLII.
Figure 43:
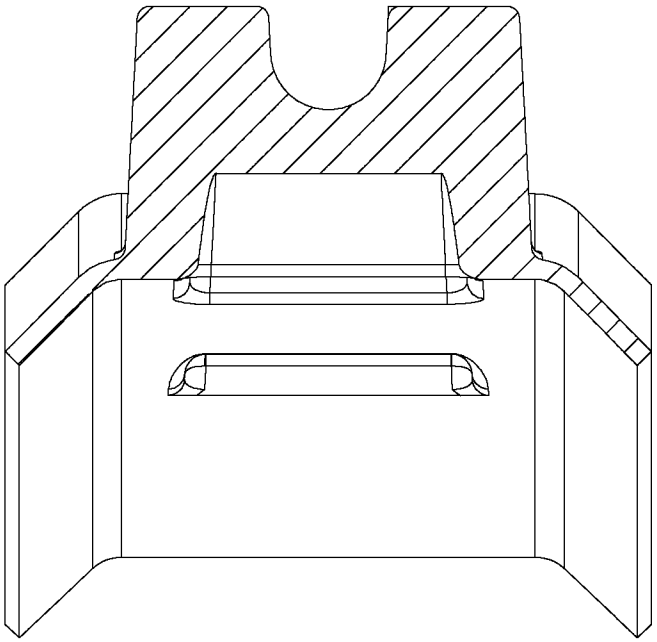
FIG. 43 is a cross-sectional view of the base shown in FIG. 40 along line XLIII.
Figure 44:
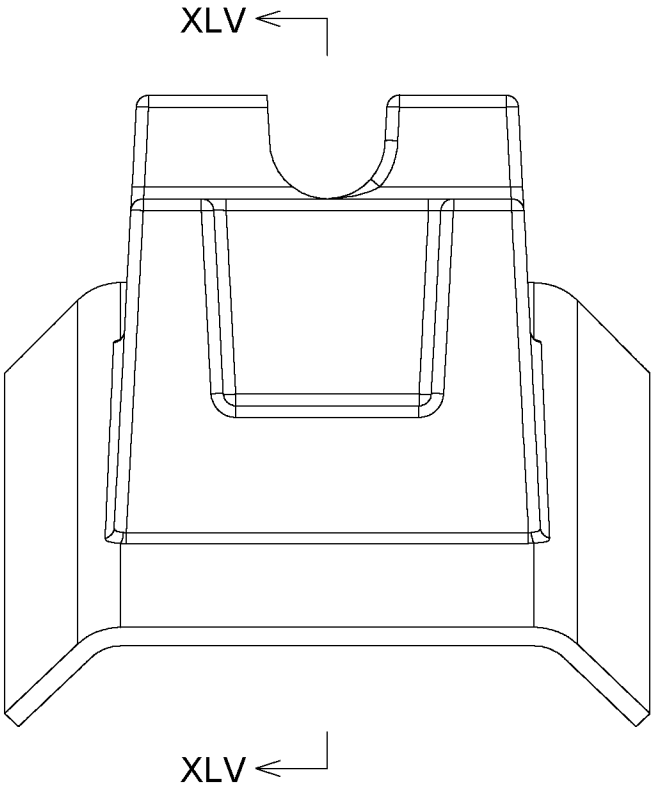
FIG. 44 is a front view of the base shown in FIG. 39.
Figure 45:
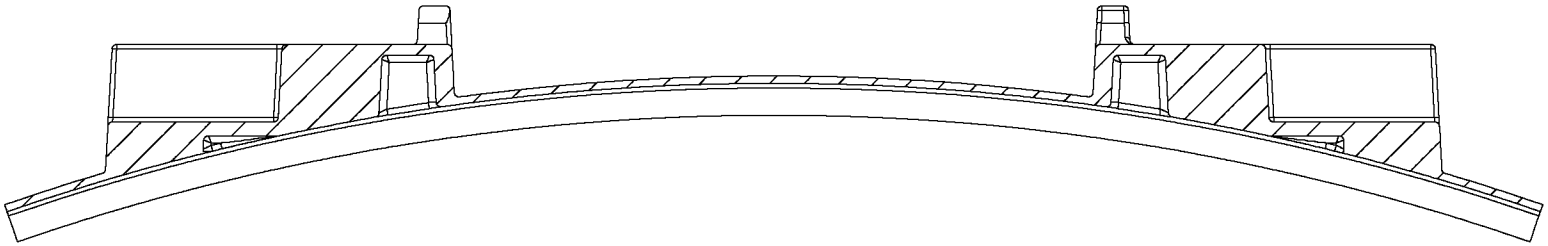
FIG. 45 is a cross-sectional view of the base shown in FIG. 44 along line XLV.
Figure 47:
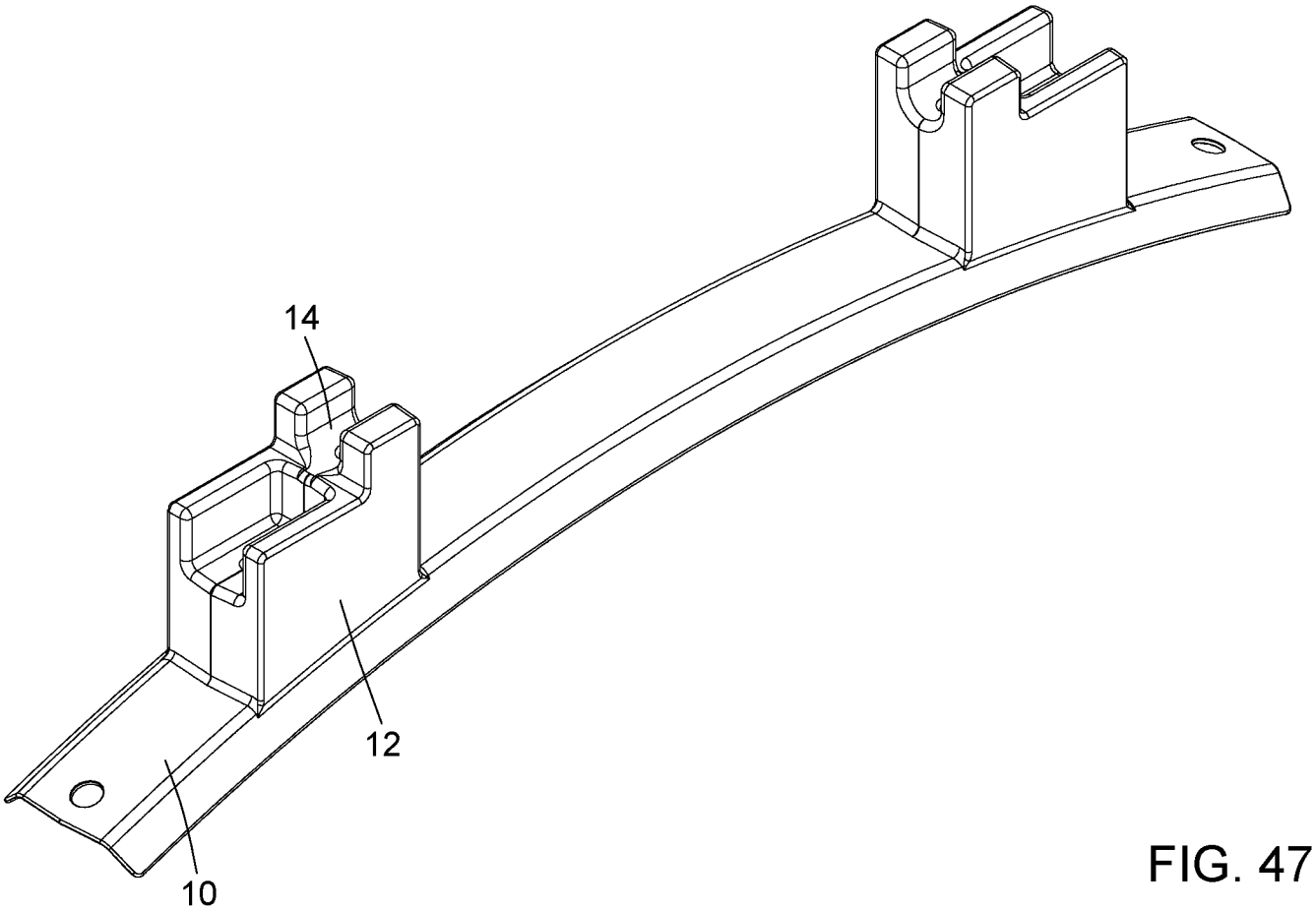
FIG. 47 is a top perspective view of an example implementation of the base of the anchoring assembly shown in FIG. 46.
Figure 48:
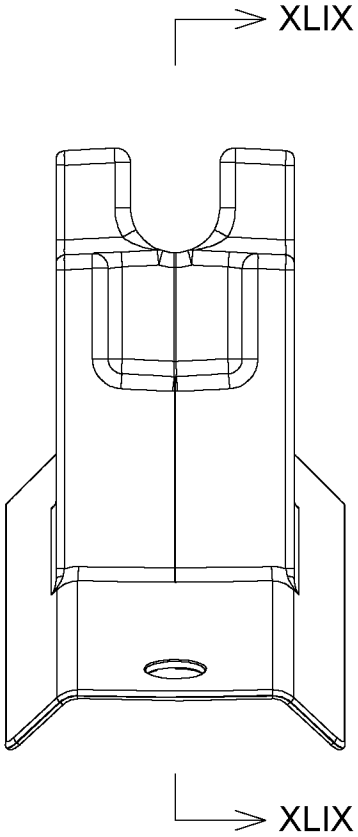
FIG. 48 is a front view of the base shown in FIG. 47.
Figure 49:
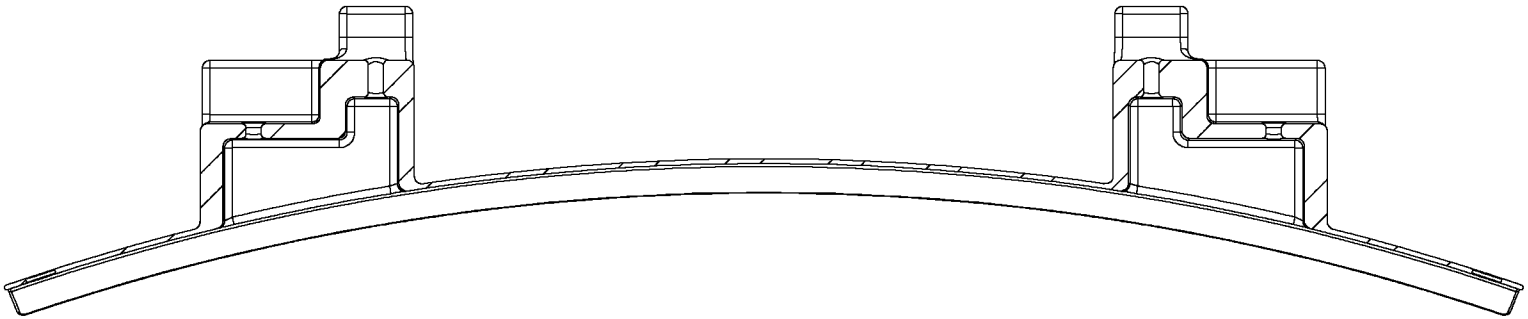
FIG. 49 is a cross-sectional view of the base shown in FIG. 48 along line XLIX.
Figure 50:
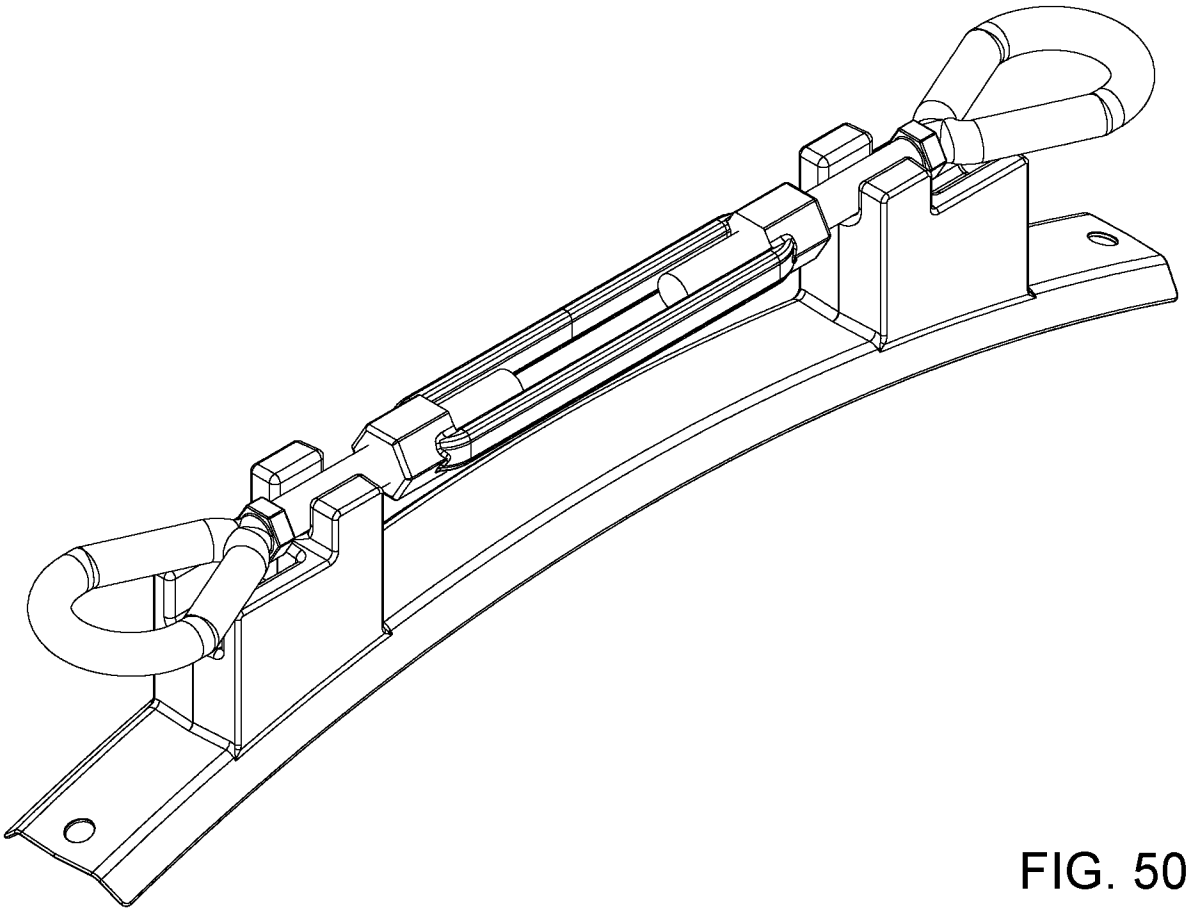
FIG. 50 is a top perspective view of the anchoring assembly shown in FIG. 46.
Figure 51:
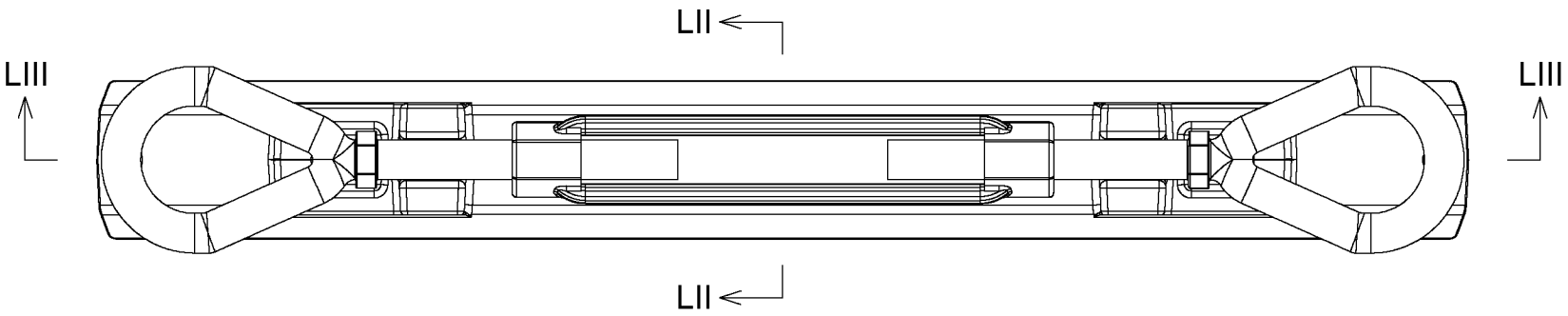
FIG. 51 is a top view of the anchoring assembly shown in FIG. 50.
Figure 52:
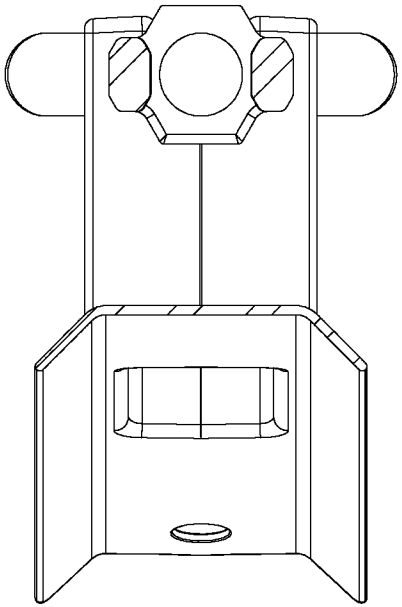
FIG. 52 is a cross-sectional view of the anchoring assembly shown in FIG. 51 along line LII.
Figure 53:
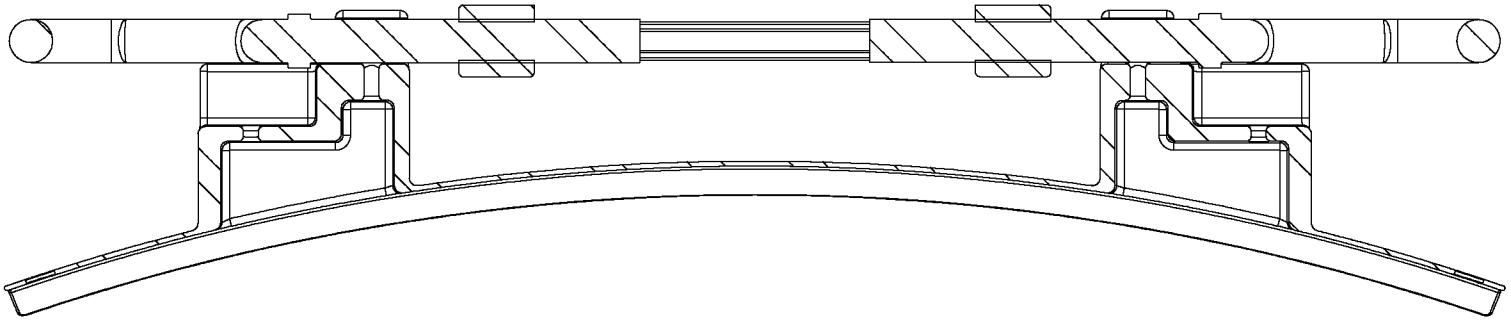
FIG. 53 is a cross-sectional view of the anchoring assembly shown in FIG. 51 along line LIII.
Figure 62:
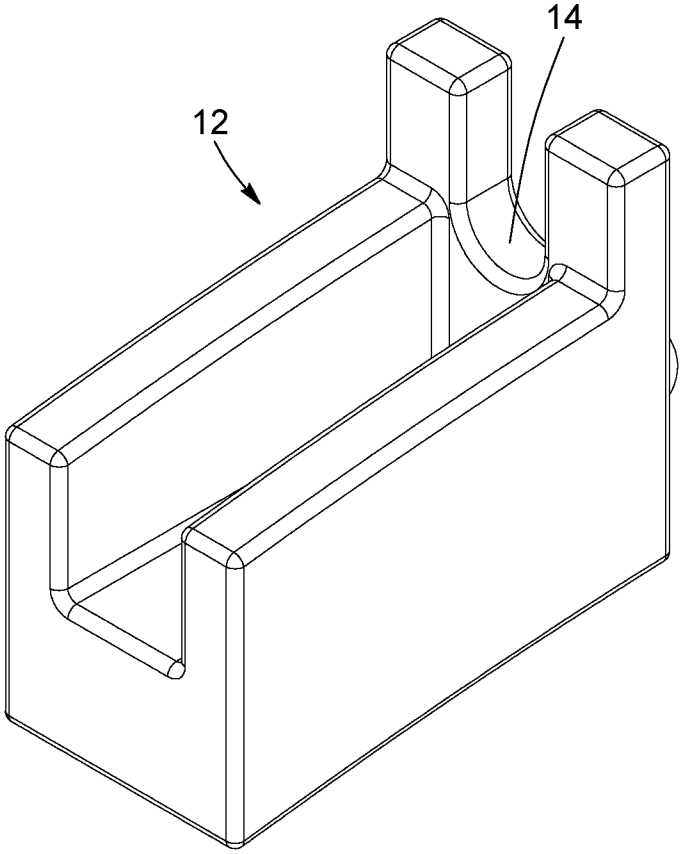
FIG. 62 is a front perspective view of an example implementation of a base of the anchoring assembly, including a seat member including a connector, the seat member having an arched bottom surface and an arched top surface.
Figure 63:
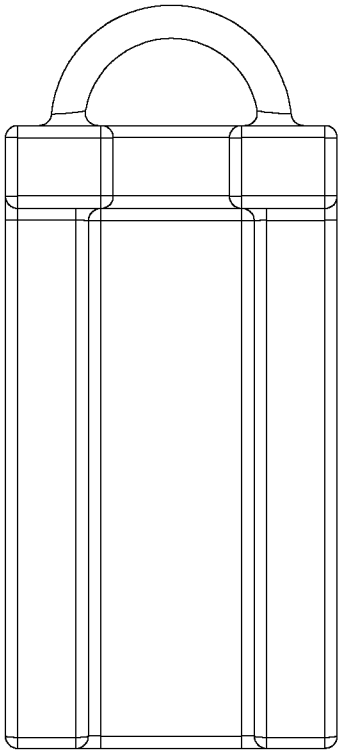
FIG. 63 is a top view of the base shown in FIG. 62.

In some implementations, for example referring to FIG. 4, the seat member 12 of the base 5 can be connected to the upper surface of the sole member 10 via welding, gluing, screwing, riveting or merely via contacting the seat member 12 of the base 5 to the upper surface of the sole member 10. In other implementations, as seen for example in FIGS. 39 and 47, the seat member 12 and the sole member 10 can be moulded as a one-piece structure (singled cast part). In yet other implementations, the base can consist of the seat member 12 as seen in FIGS. 62 to 64. For example, referring to FIG. 64, a top surface 120 of the seat member 12 (the one that receives the anchor) can be arched in the transverse direction of the storage tank, e.g., similarly to the curvature of the tank surface, such that the constraints imposed to the anchor assembly are perpendicular to a radius of the tank cross-section, and in accordance with the displacement of the seat member 12 with respect to the surface of the tank (when slidable). For example, referring to FIG. 70, the seat member 12 can include two opposed bent edge portions 122 for installation of the base on a rib of the storage tank (e.g., a fiberglass UST).

In some implementations, the sole member and seat member can be made of the same material. For example, the material can be metallic (ferrous and non-ferrous), plastic or any composite thereof. For example, the base can be made of cast iron or galvanized steel. Multiple materials can be used without departing from the scope of the present invention.

The geometry of the seat member can be adapted to accommodate the anchor, and more particularly to accommodate at least one of the tightening mechanism and the hook component of the anchor. In other words, the seat member is sized and configured to offer support while not impeding movement (e.g., translation and/or rotation) of the tightening mechanism and/or of the hook component.

Figure 20:
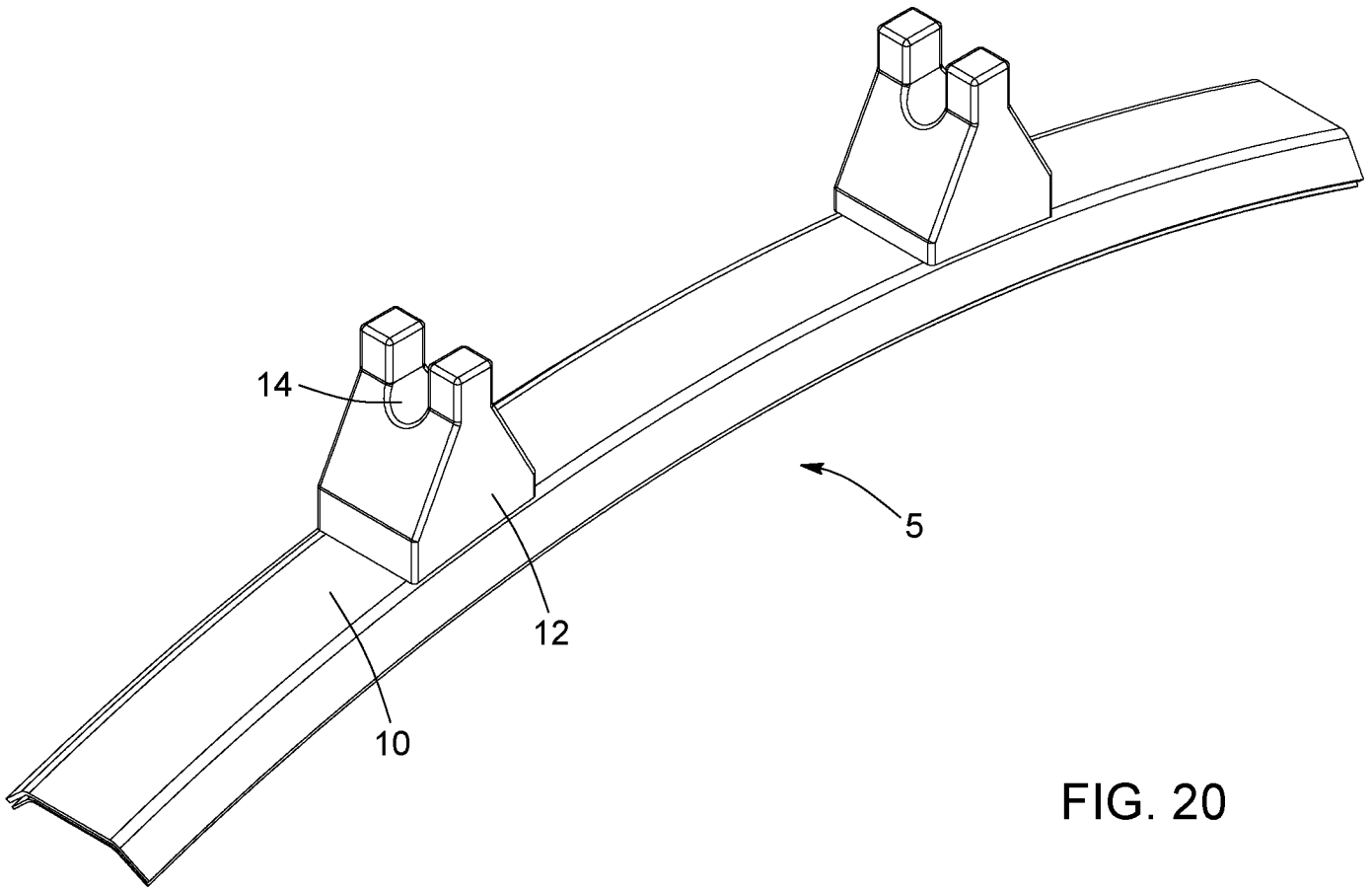
FIG. 20 is a top perspective view of a pair of seat members joined by a sole member having bent edge portions according to an implementation of the anchoring assembly.

As better seen in FIGS. 8, 20, 29, 39, 47, 59, 62 and 70, the seat member 12 can define a recess 14 that is sized and shaped to receive an element of the tightening mechanism, being the travelling member, for example. The Figures provide example designs of the recess. In some implementations, the recess can be a single notch, such as a rounded notch. For example, FIG. 20 illustrates a recess 14 that is shallower than the recess 14 illustrated in FIG. 8. In other implementations, the recess may have a geometry that prevents rotation of the travelling member 16 within the recess 14. For example, the recess can have a cross-section defining a portion of a hexagon or octagon.

Figure 21:
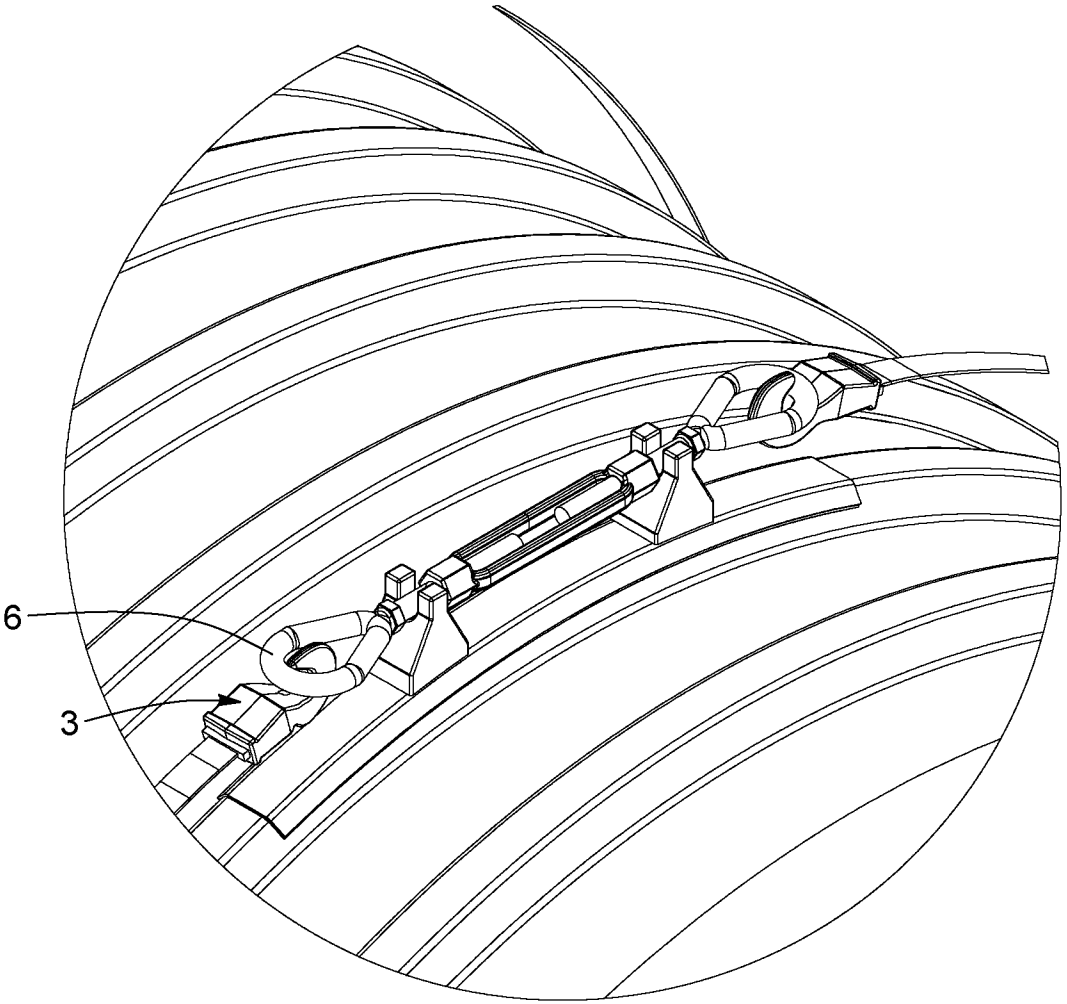
FIG. 21 is a zoomed view of a portion of FIG. 14, the anchor assembly providing anchorage and tightening to a pair of opposed straps above the tank.
Figure 22:
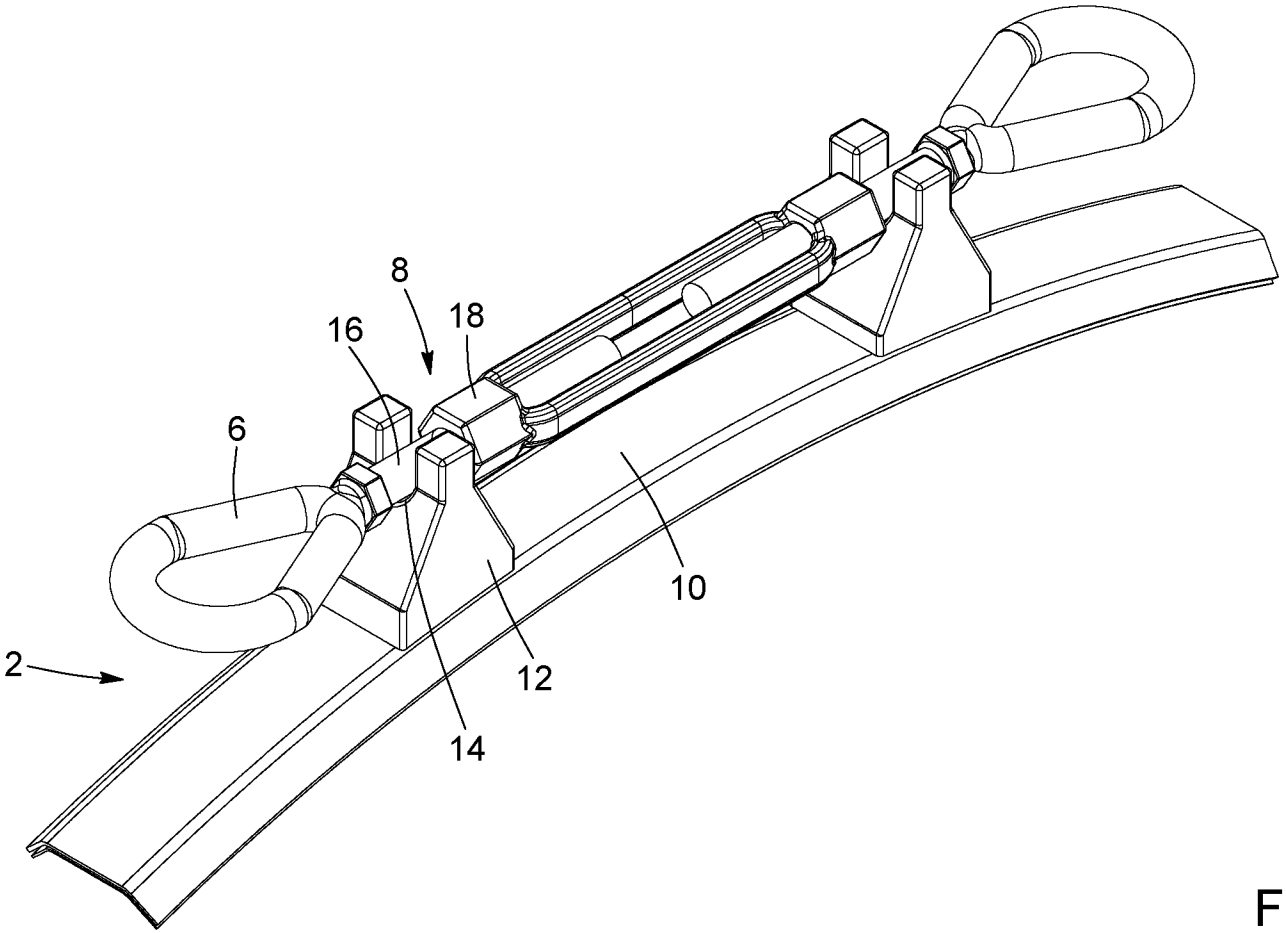
FIG. 22 is a top perspective view of the anchoring assembly shown in FIG. 21.
Figure 23:
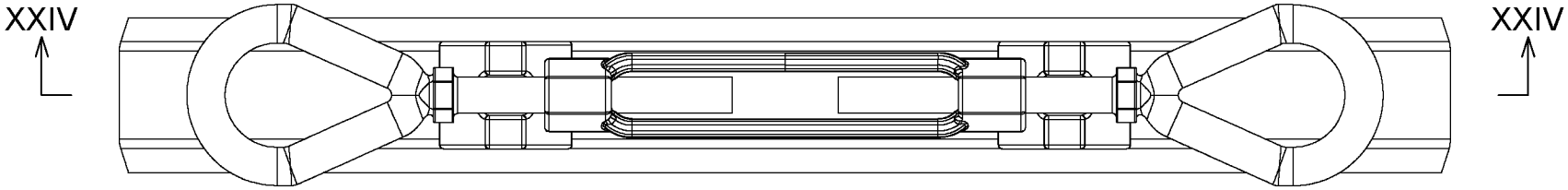
FIG. 23 is a top view of the anchoring assembly shown in FIG. 21.
Figure 24:
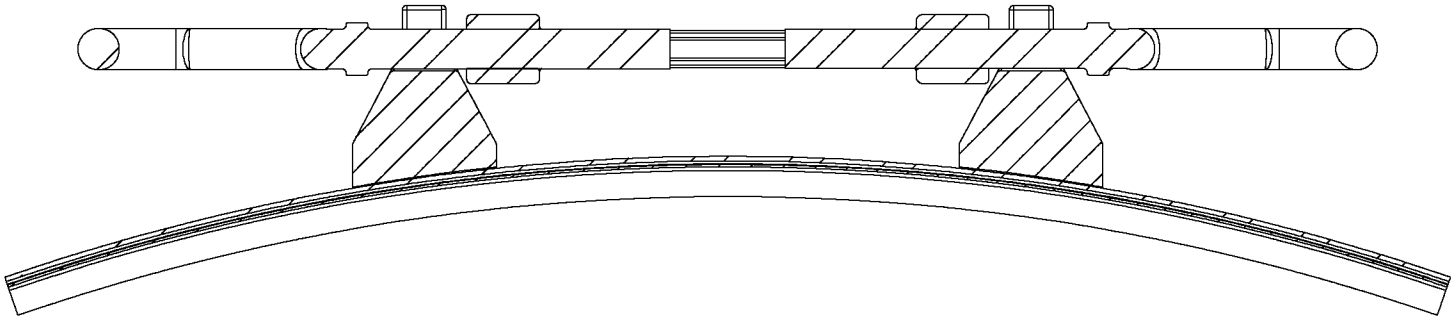
FIG. 24 is a cross-sectional view of the anchoring assembly shown in FIG. 23 along line XXIV.
Figure 25:
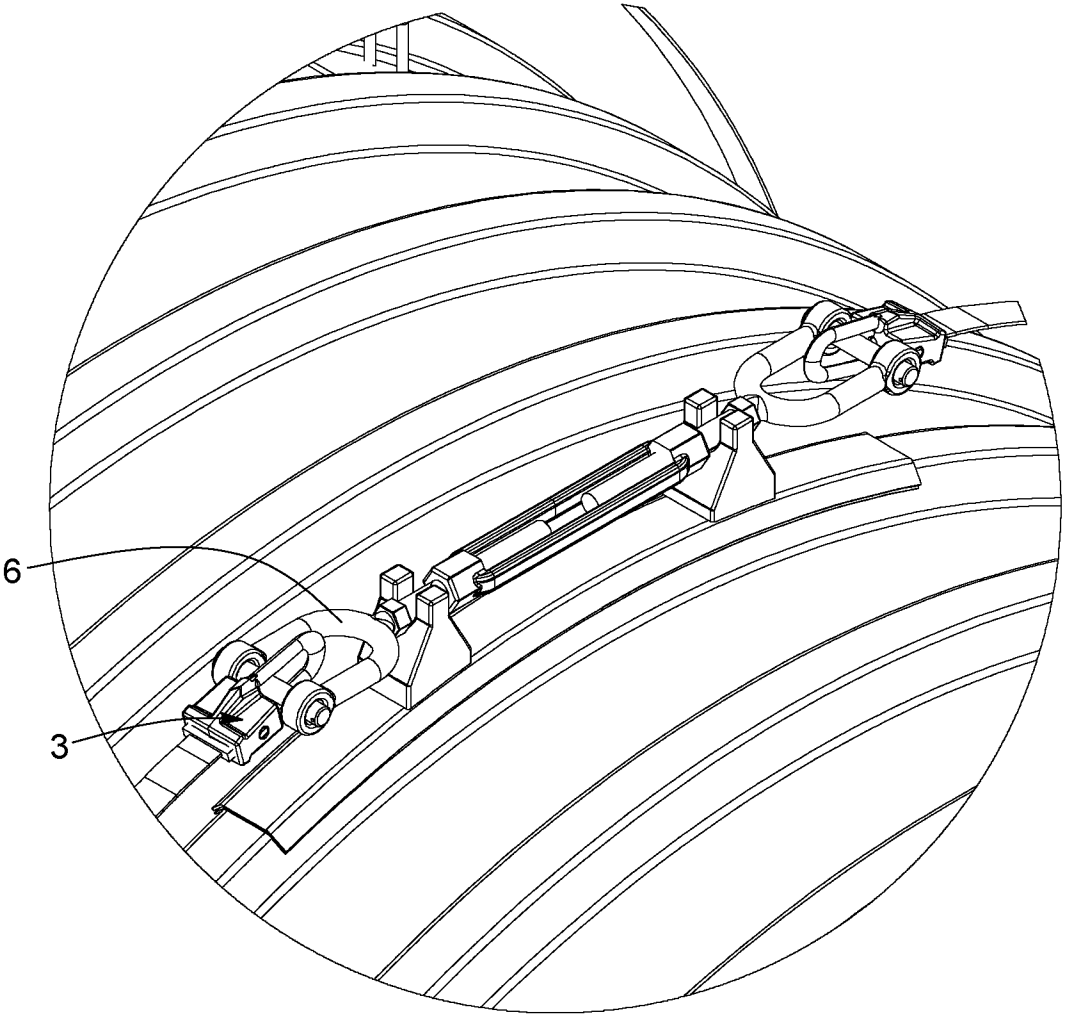
FIG. 25 is a zoomed view of another portion of FIG. 14, the anchoring assembly providing anchorage and tightening to a pair of opposed straps above the tank, and including another type of hook component in each anchor.

In some implementations, for example referring to FIG. 5, the recess 14 is sized to lodge the travelling member 16 of the tightening mechanism 8 therein, while allowing translation of the travelling member 16 with respect to the rotating member 18. The height of the seat member 12 and depth of the recess 14 can be chosen to provide room for the hook component 6 and avoid the abutment of the hook component onto the sole member 10, for example. In another example, as seen in FIG. 21, the seat member 12 can include a tapered surface from the recess 14 to the sole member 10 (or proximal to the sole member 10) to reduce the mechanical constraint imposed to the base 5 and that could further damage the surface of the tank.

Figure 35:
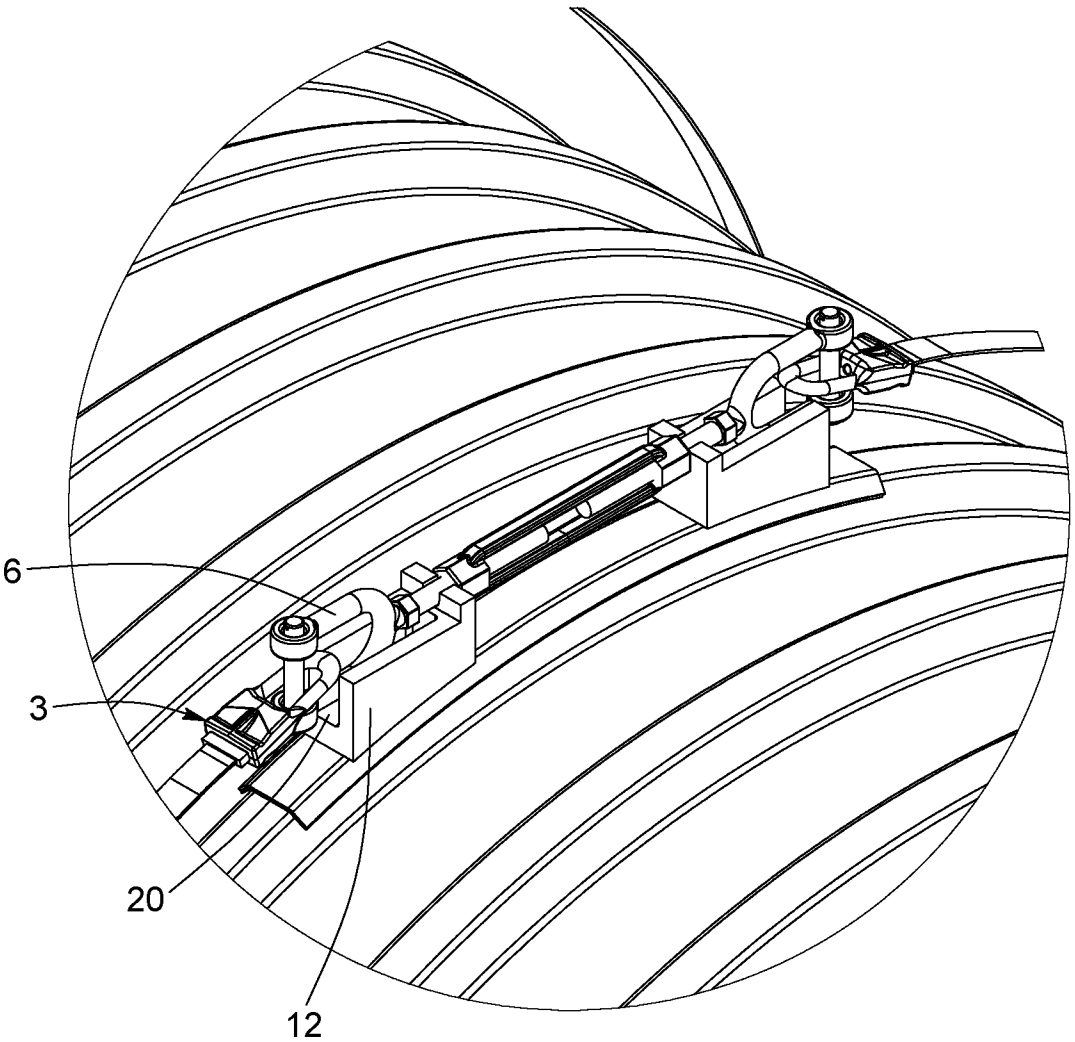
FIG. 35 is a zoomed view of another portion of FIG. 14, the anchoring assembly providing anchorage and tightening to a pair of opposed straps above the tank.
Figure 36:
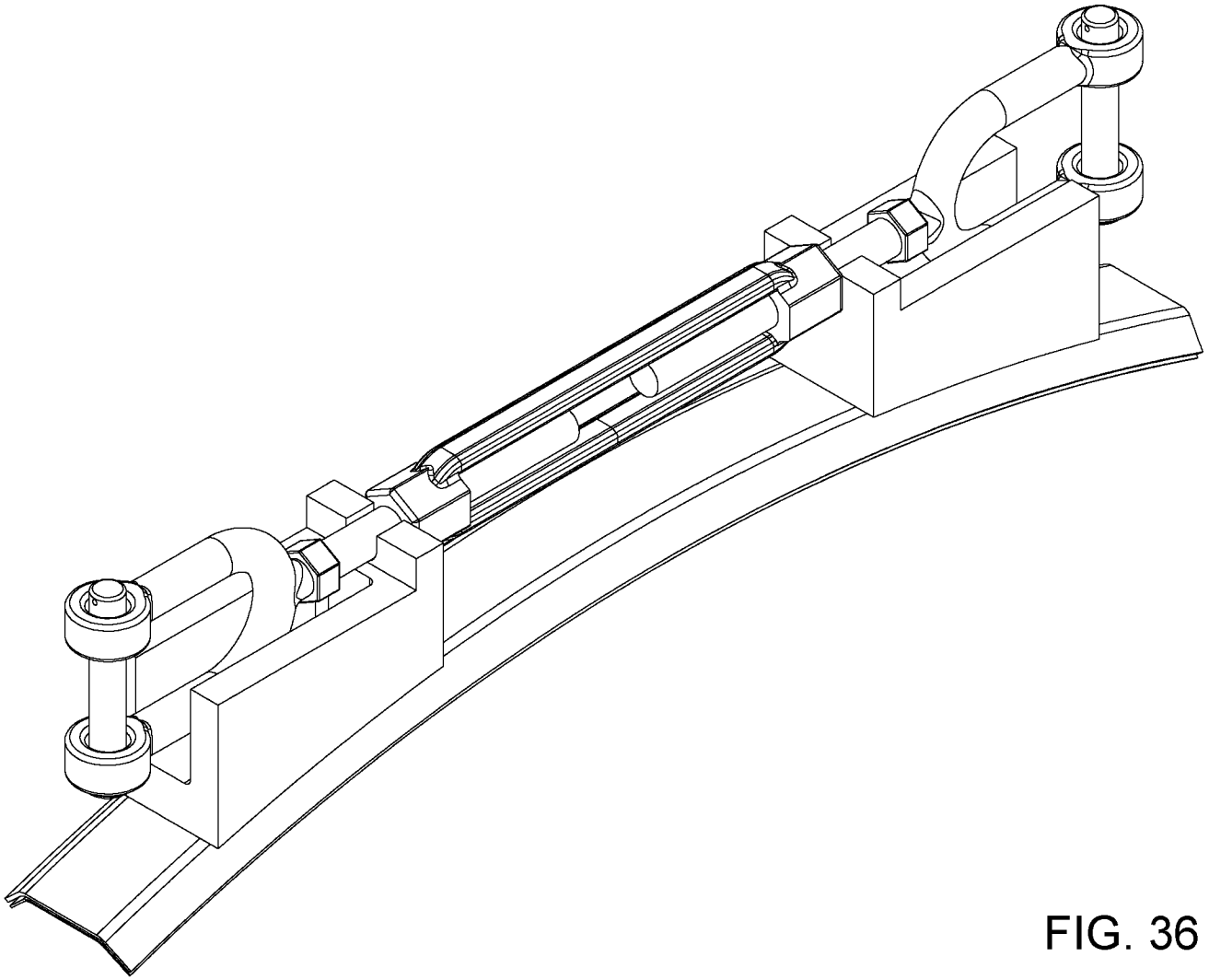
FIG. 36 is a top perspective view of the anchoring assembly shown in FIG. 35.
Figure 37:
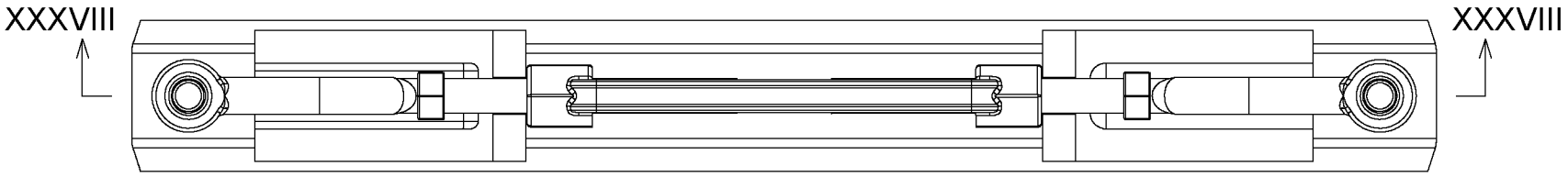
FIG. 37 is a top view of the anchoring assembly shown in FIG. 30.
Figure 38:
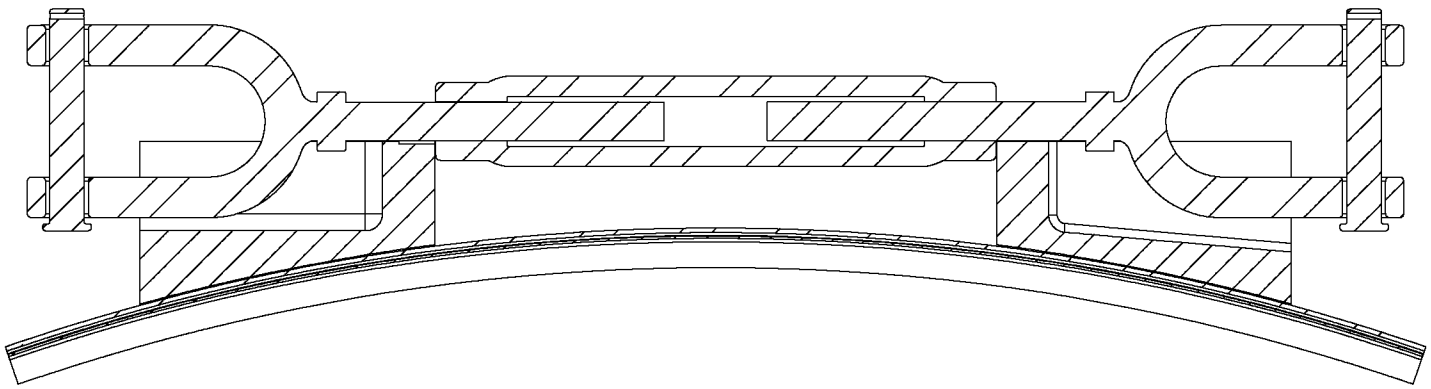
FIG. 38 is a cross-sectional view of the anchoring assembly shown in FIG. 37 along line XXXVIII.

In some implementations, as seen for example on FIGS. 29, 39, 47 and 59, the recess 14 can be a primary recess, and the seat member 12 can further include a secondary recess 20 that is sized and shaped to receive at least one of the hook component and the end of the holding strap (e.g., hook member). FIG. 54 shows for example the hook member of the holding strap 3 that is positioned within the secondary recess 20 of the seat member 12. FIG. 35 shows for example the hook component 6 that is positioned within the secondary recess 20 of the seat member 12.

Figure 68:
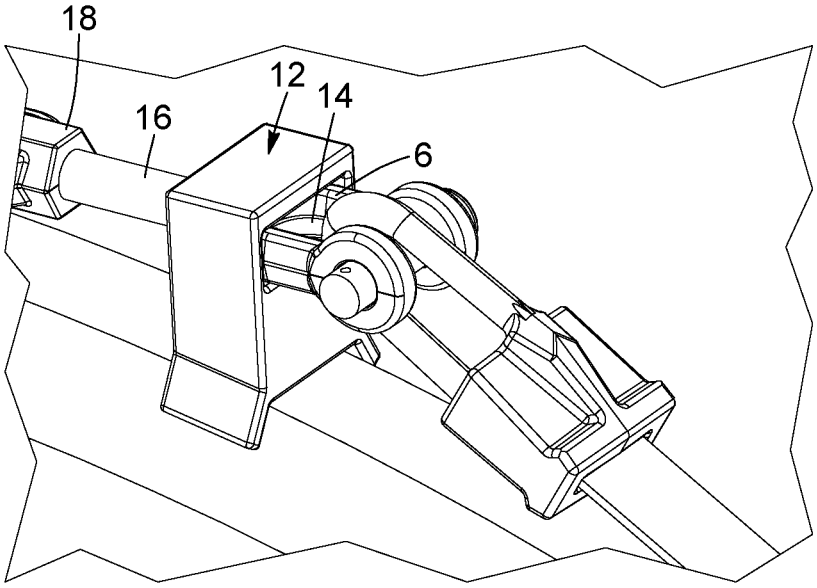
FIG. 68 is a partial top perspective view of another implementation of the anchoring assembly including a first seat member and a second seat member, each seat member comprising a channel to receive a corresponding travelling member of a first anchor and a second anchor.
Figure 69:
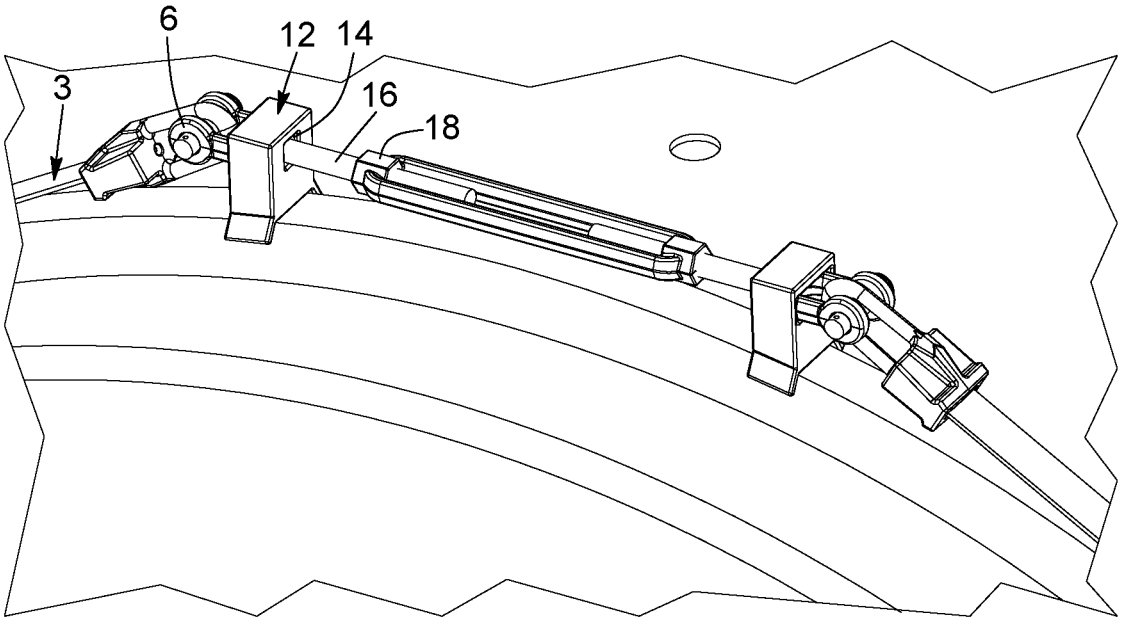
FIG. 69 is a top perspective view of the anchor assembly shown in FIG. 68, when attached to a pair of opposed holding straps.
Figure 70:
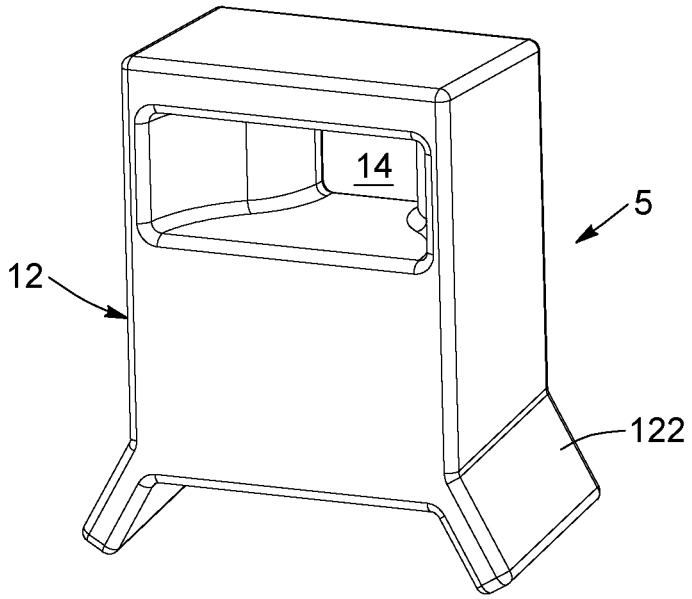
FIG. 70 is a top perspective view of a seat member of the anchor assembly shown in FIG. 68.

In some implementations, as seen in FIG. 70, the seat member 12 of the base 5 can be securable to the top surface of the tank via the two opposed bent edge portions 101, and the recess 14 is designed as a channel that can receive the travelling member of the tightening mechanism there through. Referring to FIGS. 68 and 69, the travelling member 16 of the tightening mechanism can be secured to the seat member 12 of the base by being inserted in the recess 14 and further engaged within the rotating member 18 of the tightening mechanism.

Figure 71:
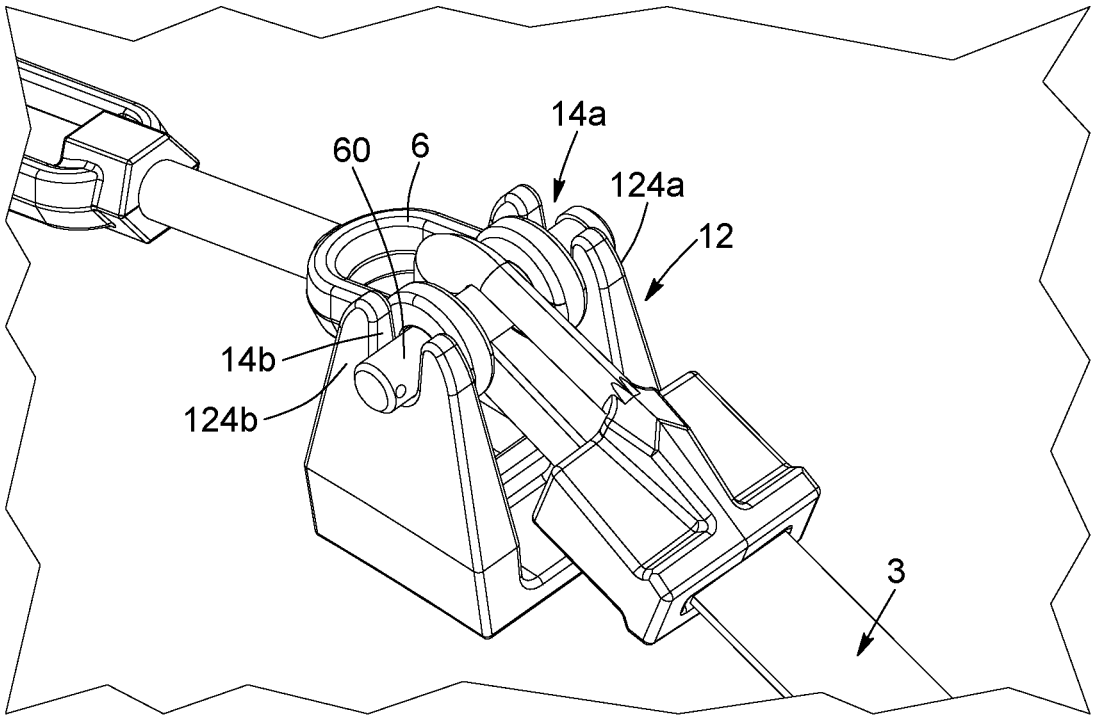
FIG. 71 is a partial top perspective view of another implementation of an anchoring assembly including a first seat member and a second seat member, each seat member comprising a pair of opposed notches to receive a corresponding hook component of a first anchor and a second anchor.
Figure 72:
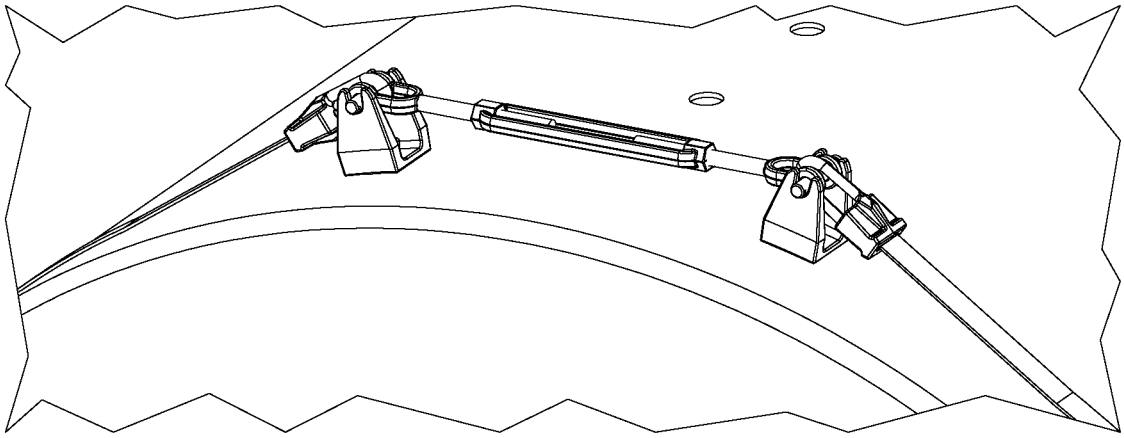
FIG. 72 is a top perspective view of the anchor assembly shown in FIG. 71, when attached to a pair of opposed holding straps.
Figure 73:
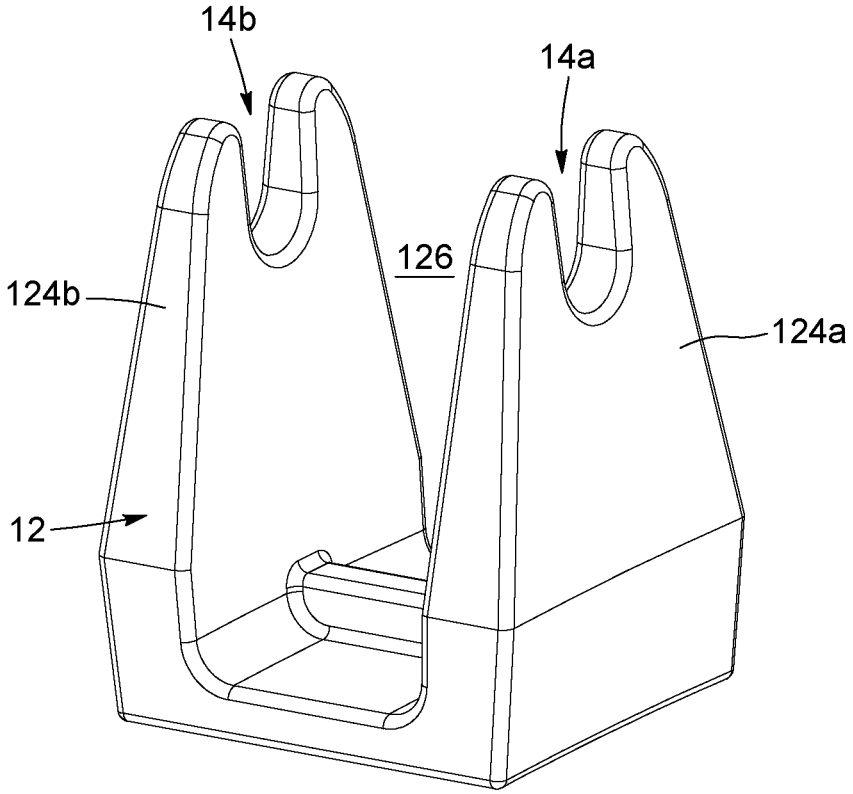
FIG. 73 is a top perspective view of a seat member of the anchor assembly shown in FIG. 71.

In still other implementations, the recess can be at least one recess that is sized and configured to receive the hook component of the anchoring assembly for securing thereof onto the base. Referring to FIG. 71, the seat member 12 can be defined as a pair of opposed recesses being notches 14*a* and 14*b* that are defined in an upper portion of the seat member 12. The notches 14*a* and 14*b* are sized and configured to receive and retain the hook component 6 of the anchoring assembly, and more particularly a pin 60 of the hook component 6 when the hook component 6 is a D-hook such as typically encountered in turnbuckles. The hook member of the holding strap 3 can be secured to the hook component 6 of the anchoring assembly by inserting the pin 60 into the hook member and further securing the pin 60 within the aligned notches 14*a* and 14*b*. As better seen in FIG. 73, in addition to the pair of opposed notches 14*a* and 14*b*, the seat member 12 can define a pair of upward arms 124*a* and 124*b* having a gap 126 there between, with the notches 14*a* and 14*b* being defined in an upper portion of the upward arms 124*a* and 124*b*. The gap 126 advantageously offers room to the interconnected hook component of the anchoring assembly and hook member of the holding strap.

Figure 26:
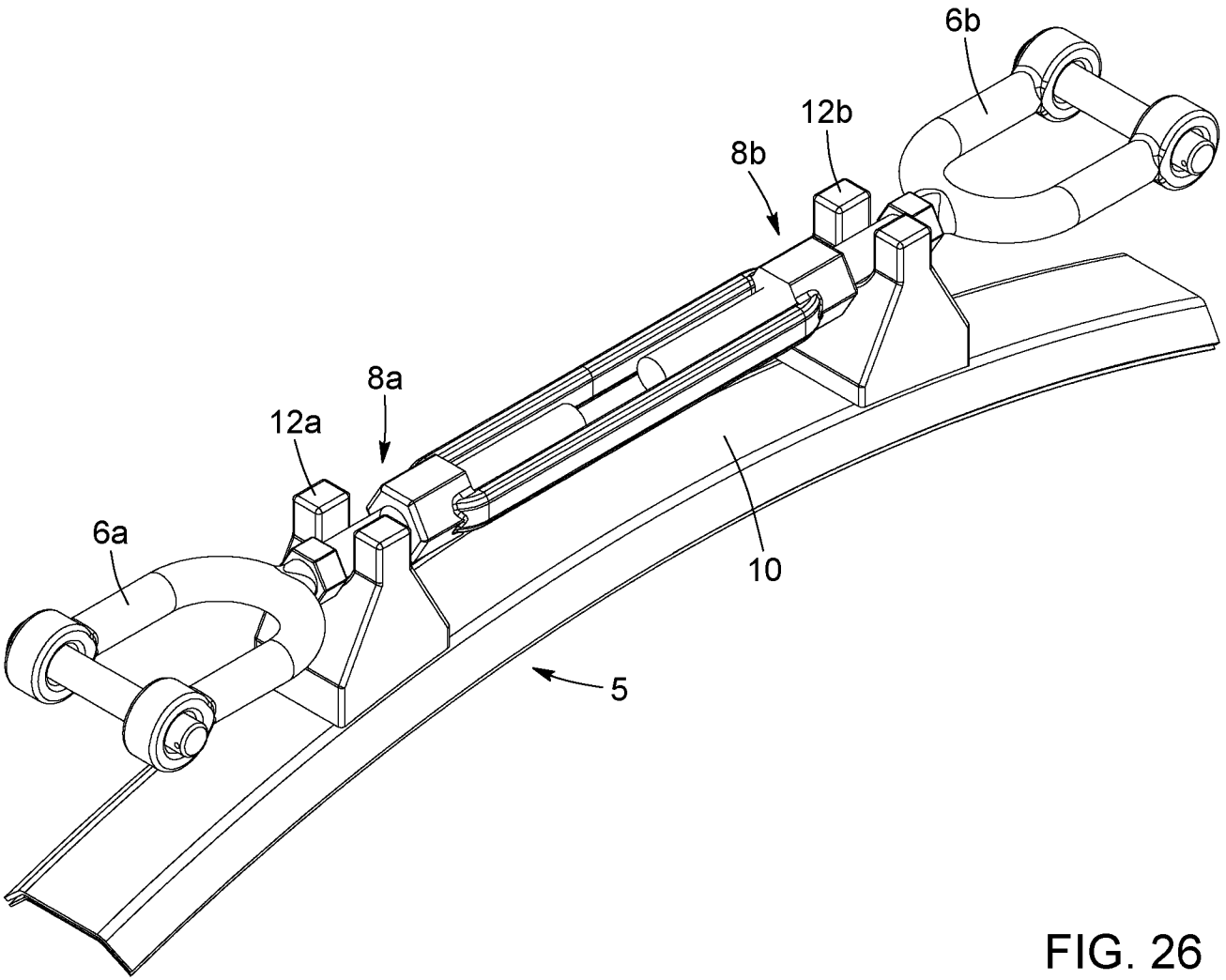
FIG. 26 is a top perspective view of the anchoring assembly shown in FIG. 25.
Figure 27:
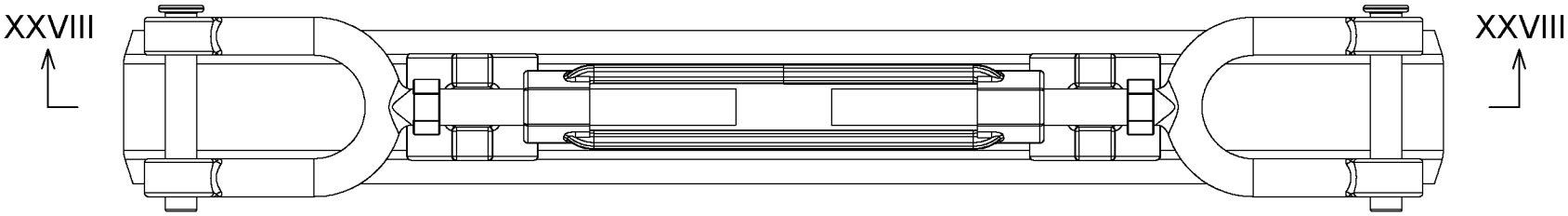
FIG. 27 is a top view of the anchoring assembly shown in FIG. 25.
Figure 28:
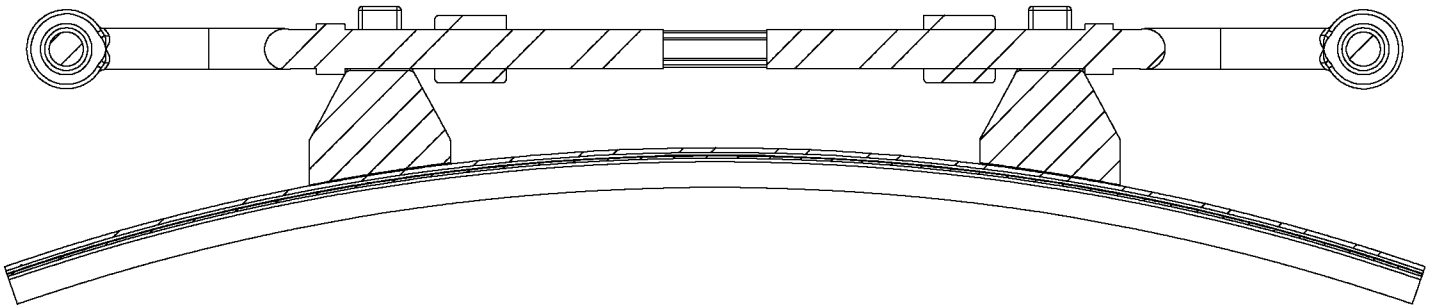
FIG. 28 is a cross-sectional view of the anchoring assembly shown in FIG. 27 along line XXVIII.
Figure 29:
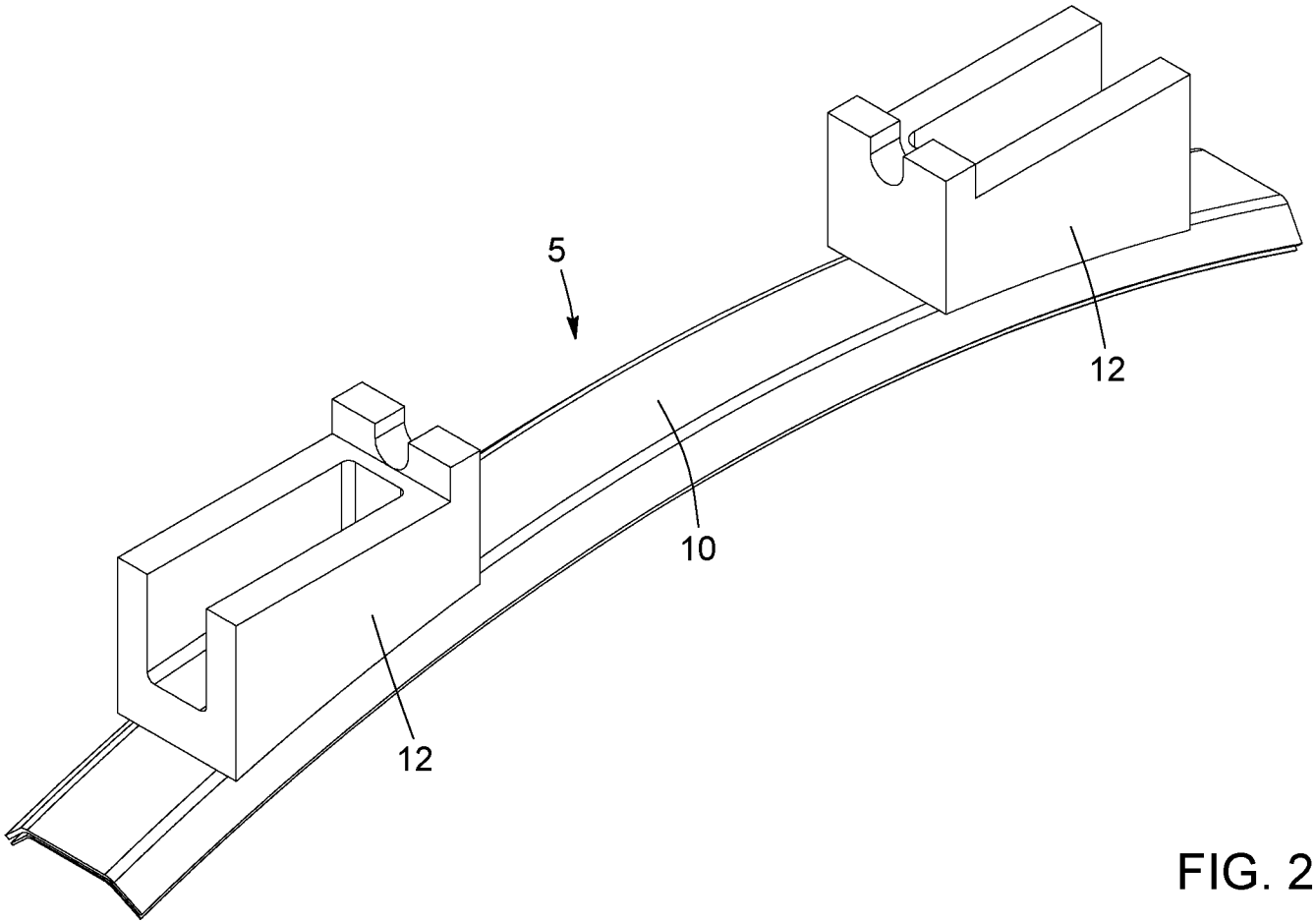
FIG. 29 is a top perspective view of an example implementation of the base of the anchoring assembly.
Figure 30:
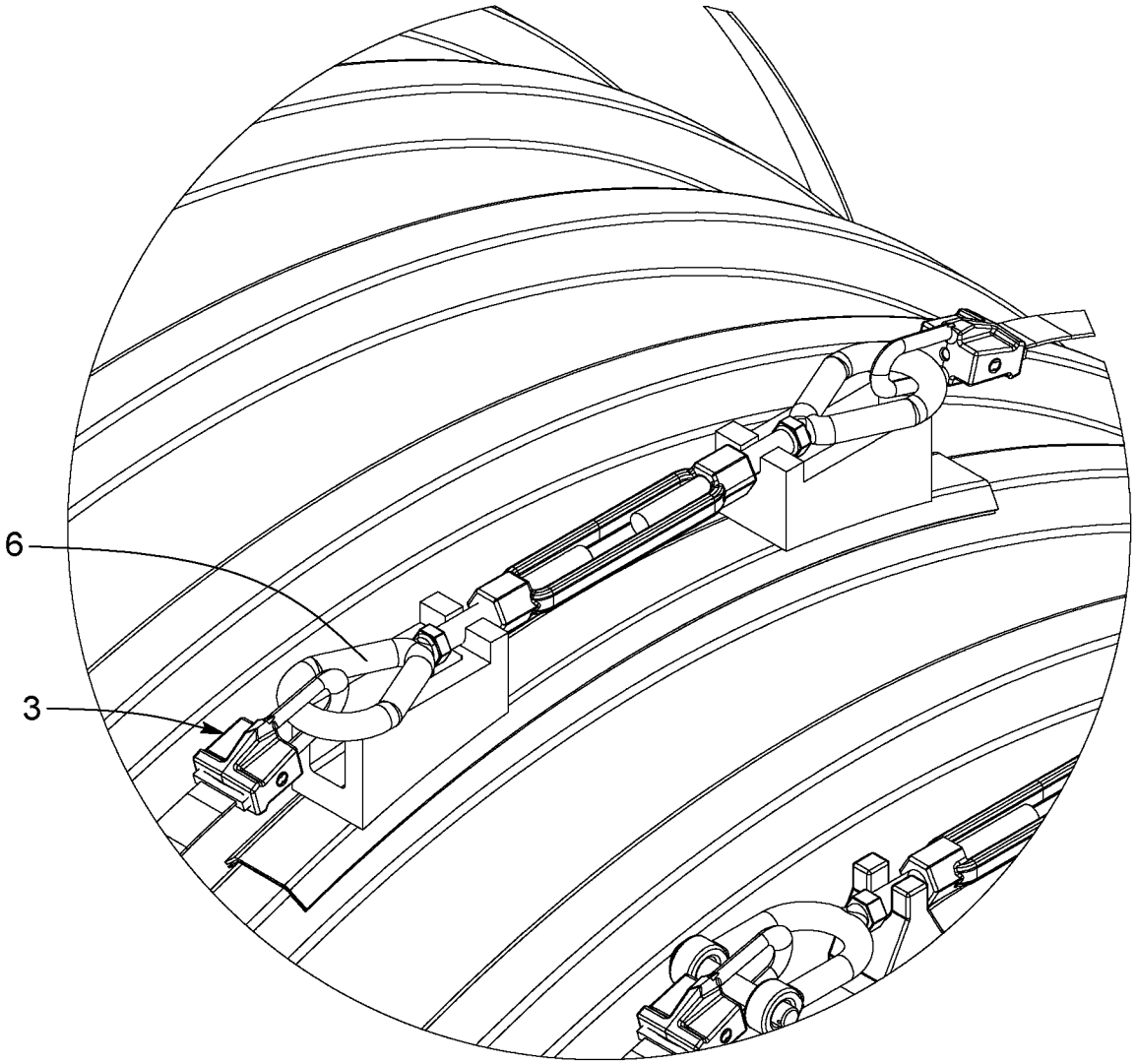
FIG. 30 is a zoomed view of another portion of FIG. 14, the anchor assembly providing anchorage and tightening to a pair of opposed straps above the tank, and including the base as seen in FIG. 29.

Although implementations of the anchoring assembly can be described herein with respect to one holding strap extending from the top of the tank down to a side of the tank, it should be noted that the same base can serve to accommodate two hook components and two tightening mechanisms in a symmetrical fashion with respect to the axial direction of the storage tank, so as to provide anchorage to a pair of holding straps provided at each side of the tank as illustrated in FIGS. 2 to 8, 17 to 53, 69 and 72. In that configuration, referring for example to FIG. 26, first and second seat members 12*a* and 12*b* are provided symmetrically on a same sole member 10 of the base 5 so as to cooperate with first and second tightening mechanisms 8*a* and 8*b* respectively and secure one holding strap (not illustrated) to each one of hook components 6*a* and 6*b*. In other implementations, as seen in FIGS. 54 to 60, first and second bases 5*a* and 5*b* can be provided at a top region of the tank. For example, referring to FIG. 54, the first and second bases 5*a* and 5*b* are positioned symmetrically to one another with respect to the axial direction of the tank so as to each secure first and second tightening mechanisms 8*a* and 8*b*.

Figure 58:
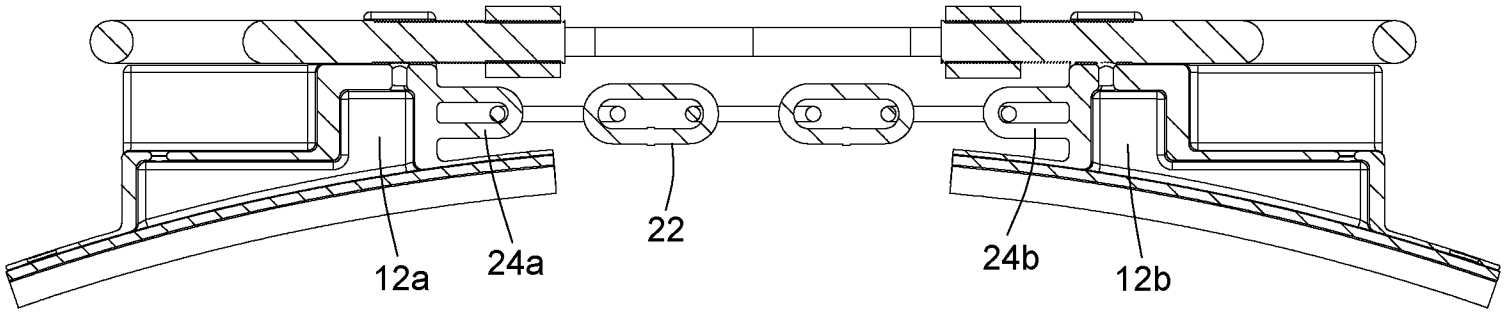
FIG. 58 is a cross-sectional view of the anchoring assembly shown in FIG. 57 along line LVIII.
Figure 59:
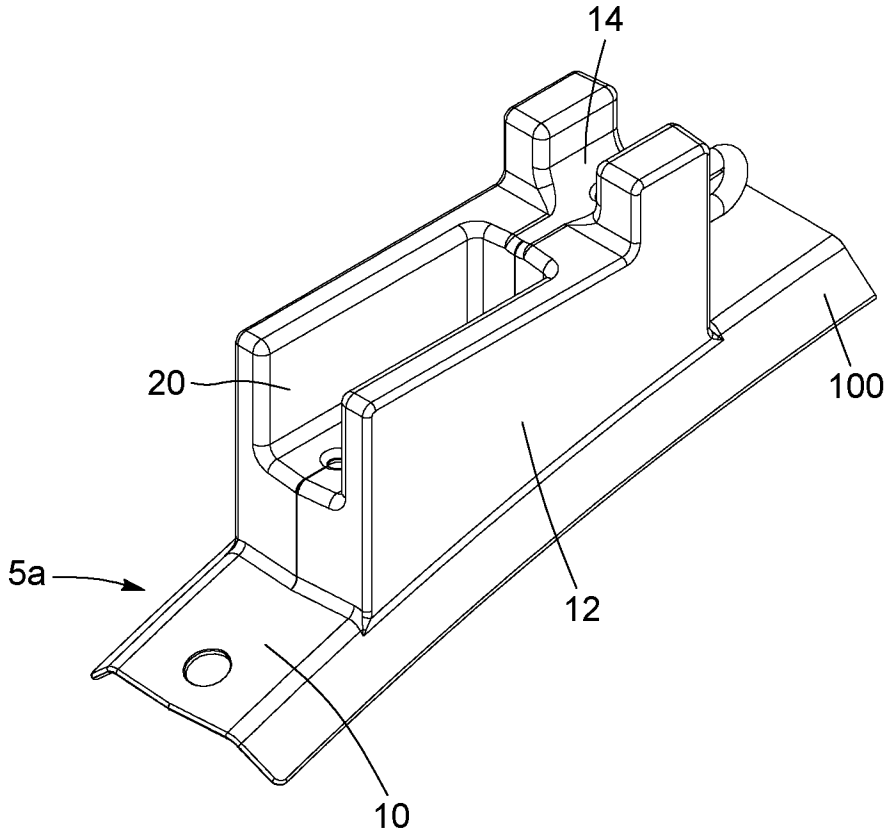
FIG. 59 is a front perspective view of an example implementation of a base of the anchoring assembly.
Figure 60:
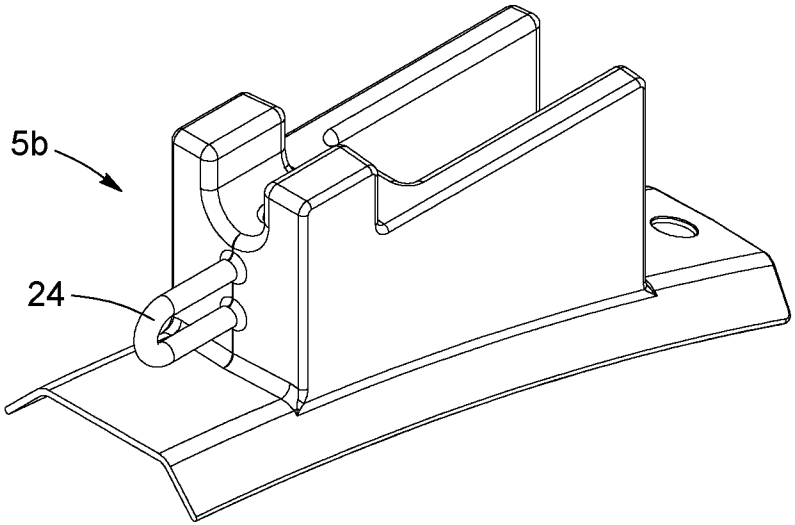
FIG. 60 is a rear perspective view of the base shown in FIG. 59.

When two bases are used in connection with two anchors, the bases can be joined via a link member, such as a cable, rope or chain 22 as seen in FIG. 58. In that configuration, each seat member (12*a*, 12*b*) can include a connector (24*a*, 24*b*) for connection to the chain 22. As better seen in FIG. 60, the connector 24 can be a loop member protruding from a side of the seat member for connection to an end element of the chain. The link member can facilitate the distribution of the mechanical constraints that are imposed on the bases when opposed tightened straps are attached to the corresponding hook components. In addition, as seen in FIG. 58, the use of two bases (5*a*, 5*b*) attached via the chain 22 can be advantageous in certain situations, as each base (5*a*, 5*b*) can slide with respect to the surface of the tank. The material (e.g., low friction material) and fixation of the base with respect to the tank can allow for this sliding. For example, when the hook component 6*b* abuts the seat member 12*b* of the base 5*b*, the travelling member 16*b* can further advance towards the rotating member 18*b* via sliding of the sole member 10*b* with respect to the tank surface. Such sliding can indeed provide a further range of translation to the hook component, thereby further tightening of holding straps.

It should be noted that the geometry of the sole member and positioning of the seat member with respect to the sole member is not to be limited to those illustrated in the Figures, and can be varied in accordance with multiple parameters, including the geometry of the tightening mechanism, the geometry of the hook component, the number of seat members and the position of the proximal end of the holding strap with respect to the top of the tank.

In some other implementations, as seen in FIGS. 62 and 63, the base of the anchor assembly may simply consist of the seat member that is directly securable to the top surface of the tank (without any intermediate sole member as described herein). The seat member can be as defined and illustrated herein, and configured to receive the anchor for attachment of the holding strap. The seat member can include a connector for association to another opposed seat member.

In another aspect, there is provided a system for anchoring an underground storage tank to the ground. The system includes the anchoring assembly as described herein and securable to a top region of the storage tank, an anchor base that can be laid below the ground, and a holding strap having a distal end that is secured to the anchor base (e.g., via a retention mechanism) and a proximal end that is secured to the hook component of the present anchoring assembly.

Referring to FIG. 1, there is provided a method for anchoring the holding strap 3 to a side of the storage tank via the presently encompassed anchoring assembly 2. The method further comprises placing the anchor 4 onto the base 5, e.g., via the seat member, and anchoring the holding strap 3 to the hook component of the anchor 4. Tension of the holding strap can then be adjusted via actuation/rotation of the rotating member with respect to the travelling member of the tightening mechanism. More particularly, several techniques can be employed to secure and tighten a holding strap to the tank via attachment to both the anchor base and anchor assembly. For example, the holding strap can be secured to each one of the anchor bases and the anchor assembly on the transport truck or on-site, before being lowered into an excavation pit. Once lowered, a portion of the pit can be filled with a filler such as soil, gravel and/or crushed stone. Then, tension of the holding strap is adjusted via actuation of the rotating member of each anchor assembly located at the top of the tank.

Method implementations of the present invention may be performed or completed manually, automatically, or a combination thereof, selected steps or tasks.

Meanings of technical and scientific terms used herein are to be commonly understood as by one of ordinary skill in the art to which the invention belongs, unless otherwise defined.

It should be noted that the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only. Therefore, the descriptions, examples, methods and materials presented herein are not to be construed as limiting but rather as illustrative only.

In the present description, an implementation/embodiment is an example of the invention. The various appearances of "one embodiment," "an embodiment", "some embodiments" or "some implementations" do not necessarily all refer to the same implementation. Although various features of the invention may be described in the context of a single embodiment, the features may also be provided separately or in any suitable combination. Conversely, although the invention may be described herein in the context of separate implementations for clarity, the invention may also be implemented in a single embodiment.

It is to be understood that where the specification states that a component, feature, structure, or characteristic "may", "might", "can" or "could" be included, that particular component, feature, structure, or characteristic is not required to be included.

Several alternative implementations and examples have been described and illustrated herein. The implementations of the invention described above are intended to be exemplary only. A person of ordinary skill in the art would appreciate the features of the individual embodiments, and the possible combinations and variations of the components. A person of ordinary skill in the art would further appreciate that any of the embodiments and implementations could be provided in any combination with other embodiments and implementations disclosed herein. It is understood that the invention may be embodied in other specific forms without departing from the central characteristics thereof. The present examples and implementations, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims. For example, the implementations of the anchoring assembly illustrated in FIG. 54 could be modified to include two arched sole members linked by a chain and adapted to follow the substantially flat surface of a metallic UST (rather than the bent edges adapted for the rib of a fiberglass UST). FIG. 54 illustrates two anchor assemblies being joined or linked via two locations, firstly via the chain linking the two bases 5*a* and 5*b*, and secondly via the elongated body 28 linking the two opposed tightening mechanism 8*a* and 8*b*. Two separate sole members 10*a* and 10*b* can thus be used to install two opposed tightening mechanisms 8*a* and 8*b*. This configuration offers flexibility for positioning each base 5*a* and 5*b* at a distance from one another, such distance being tailored to the size and design of the tank and of the remaining components of the anchor assemblies. Advantageously, the seat member is cast with the sole member of the base to form a one-piece structure that is easily manufactured and positionable onto the surface of the tank and independently from the opposed base.

Any publications, including patents, and patent applications, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

The invention claimed is:

1. An anchoring assembly for securing at least one holding strap to a storage tank, the anchoring assembly comprising:

a base that is connectable to a top surface of the storage tank, the base comprising:

a seat member extending upwardly from the top surface of the storage tank; and an anchor that is reversibly secured to the base and positionable in a transverse direction of the storage tank, the anchor comprising:

a hook component being configured to anchor a proximal end of the holding strap; and a tightening mechanism that is connected to the hook component and being supported above the top surface of the storage tank by the seat member of the base, wherein the tightening mechanism is actuable to move the hook component with respect to the top surface of the storage tank, thereby modifying a tension of the at least one holding strap wherein the hook component defines a loop and the at least one holding strap is engageable to the hook component via insertion of the proximal end of the at least one holding strap into the loop of the hook component.

2. The anchoring assembly of claim 1, wherein the seat member defines at least one recess for receiving the anchor therein and position the tightening mechanism above the top surface of the storage tank.

3. The anchoring assembly of claim 2, wherein the at least one recess is a single notch defined in an upper portion of the seat member.

4. The anchoring assembly of claim 2, wherein the seat member includes a pair of opposed upward arms and the at least one recess comprises a pair of opposed notches, each notch being defined in an upper portion of the upward arms.

5. The anchoring assembly of claim 2, wherein the at least one recess is a single channel defined in an upper portion of the seat member, with the anchor being slidable through the channel.

6. The anchoring assembly of claim 1, wherein the anchor is at least one anchor, the at least one holding strap comprising a first holding strap and a second holding strap, and the at least one anchor comprising a first anchor and a second anchor to secure the first holding strap and the second holding strap on each opposed side of the storage tank, wherein the tightening mechanism of the first anchor is connected to the tightening mechanism of the second anchor via an elongated connecting body.

7. The anchoring assembly of claim 1, wherein the base is at least one base, and the at least one base comprises a first base and a second base positionable onto the top surface of the storage tank in axial symmetry with respect to each other.

8. The anchoring assembly of claim 7, wherein the at least one holding strap comprises a first holding strap and a second holding strap, and the seat member of the first base and the seat member of the second base are connected via a link member to further distribute mechanical constraints that are imposed by opposed tensions of the first holding strap and the second holding strap.

9. The anchoring assembly of claim 7, wherein the seat member of the first base and the seat member of the second base are connected to a same sole member extending along the top surface of the storage tank.

10. The anchoring assembly of claim 1, wherein the loop is a closed loop that includes a V-shaped portion connected to the tightening mechanism and a U-shaped portion connected to the proximal end of the holding strap.

11. The anchoring assembly of claim 1, wherein the loop is a closed loop formed by a rod member that has a circular cross-section.

12. The anchoring assembly of claim 1, wherein the seat member rests on the top surface of the storage tank.

13. The anchoring assembly of claim 12, wherein the plurality of seat members are slidably engaged with the top surface of the storage tank via surface friction.

14. An anchoring assembly for securing a holding strap to a storage tank, the anchoring assembly comprising:

a base that is connectable to a top surface of the storage tank, the base comprising:

a plurality of seat members extending upwardly from the top surface of the storage tank; and a sole member having a lower surface that rests onto the top surface of the storage tank, the sole member being arched along a transverse direction of the storage tank to follow a curvature of the top surface of the tank;

an anchor that is reversibly secured to the base and positionable in a transverse direction of the storage tank, the anchor comprising:

a hook component being configured to anchor a proximal end of the at least one holding strap; and a tightening mechanism that is connected to the hook component and being supported above the top surface of the storage tank by the plurality of seat members of the base, wherein the tightening mechanism is actuable to move the hook component with respect to the top surface of the storage tank, thereby modifying a tension of the at least one holding strap.

15. The anchoring assembly of claim 14, wherein the plurality of seat members are protruding from an upper surface of the sole member.

16. The anchoring assembly of claim 14, wherein the tightening mechanism is directly connected to the hook component.

17. The anchoring assembly of claim 14, wherein the sole member is slidably engaged with the top surface of the storage tank via surface friction.

18. An anchoring assembly for securing at least one holding strap to a storage tank, the anchoring assembly comprising:

a base that is connectable to a top surface of the storage tank, the base comprising:

a seat member extending upwardly from the top surface of the storage tank; and an anchor that is reversibly secured to the base and positionable in a transverse direction of the storage tank, the anchor comprising:

a hook component being configured to anchor a proximal end of the holding strap; and a tightening mechanism that is connected to the hook component and being supported above the top surface of the storage tank by the seat member of the base, wherein the tightening mechanism is actuable to move the hook component with respect to the top surface of the storage tank, thereby modifying a tension of the at least one holding strap, and the tightening mechanism comprises:

a travelling member being operatively connected to the hook component; and a rotating member being operatively connected to the travelling member, wherein the rotation of the rotating member actuates the displacement of the travelling member, thereby modifying the tension of the at least one holding strap that is secured to the hook component.

19. The anchoring assembly of claim 18, wherein the rotating member is abutted to the seat member of the base.

20. The anchoring assembly of claim 18, wherein the seat member defines a recess that is sized and shaped to receive the travelling member of the tightening mechanism therein, and to allow translation of the travelling member with respect to the recess.

21. The anchoring assembly of claim 20, wherein the recess is a primary recess, and the seat member further comprises a secondary recess that is sized and shaped to receive at least one of the hook component and the end of the holding strap.

22. The anchoring assembly of claim 18, wherein the travelling member comprises a threaded bolt and the rotating member comprises a complementary nut, the hook component being operatively connected to a proximal end of the threaded bolt, and the threaded bolt being movable with respect to the nut via rotation of the nut.

23. The anchoring assembly of claim 22, wherein the hook component is integrally moulded with the threaded bolt, and wherein rotation of the nut leads to screwing or unscrewing of the threaded bolt, to adjust the tension of the holding strap that is attached thereto.

24. The anchoring assembly of claim 18, wherein the travelling member is a threaded bore, and the rotating member is a complementary threaded bolt that is rotatable within the threaded bore to actuate translation of the threaded bore and the connected hook component.

25. The anchoring assembly of claim 18, wherein the hook component forms a one-piece structure with the travelling member.

26. The anchoring assembly of claim 18, wherein the seat member rests on the top surface of the storage tank.

27. The anchoring assembly of claim 26, wherein the seat member is slidably engaged with the top surface of the storage tank via surface friction.

* * * * *